US011691852B2

(12) United States Patent
Kashiwakura

(10) Patent No.: US 11,691,852 B2
(45) Date of Patent: Jul. 4, 2023

(54) HEIGHT RAISING MEMBER FOR RAISING MOUNTING POSITION OF MOTOR FOR ELEVATOR DOOR, CAR DOOR DEVICE EQUIPPED WITH HEIGHT RAISING MEMBER FOR RAISING MOUNTING POSITION OF MOTOR FOR ELEVATOR DOOR, AND ELEVATOR CAR EQUIPPED WITH HEIGHT RAISING MEMBER FOR RAISING MOUNTING POSITION OF MOTOR FOR ELEVATOR DOOR

(71) Applicant: FUJITEC CO., LTD., Hikone (JP)

(72) Inventor: Hiroshi Kashiwakura, Hikone (JP)

(73) Assignee: FUJITEC CO., LTD., Hikone (JP)

( * ) Notice: Subject to any disclaimer, the term of this patent is extended or adjusted under 35 U.S.C. 154(b) by 0 days.

(21) Appl. No.: 17/541,351

(22) Filed: Dec. 3, 2021

(65) Prior Publication Data

US 2022/0177276 A1 Jun. 9, 2022

(30) Foreign Application Priority Data

Dec. 4, 2020 (JP) ..... JP2020-201557
May 11, 2021 (JP) ..... JP2021-080356

(51) Int. Cl.
*B66B 13/06* (2006.01)
*E05F 15/643* (2015.01)
*B66B 13/30* (2006.01)

(52) U.S. Cl.
CPC ..... *B66B 13/06* (2013.01); *B66B 13/30* (2013.01); *E05F 15/643* (2015.01); *E05Y 2900/104* (2013.01)

(58) Field of Classification Search
CPC ..... B66B 13/08; B66B 19/007; B66B 13/30; B66B 19/005; B66B 11/02
See application file for complete search history.

(56) References Cited

U.S. PATENT DOCUMENTS 6,513,628 B2 * 2/2003 Mollenauer ..... E05F 15/643 187/334
2021/0009383 A1 1/2021 Kashiwakura

FOREIGN PATENT DOCUMENTS

| | | | | | |
|---|---|---|---|---|---|
| CN | 104326344 | A | * | 2/2015 | ..... B66B 11/0226 |
| CN | 207209662 | U | | 4/2018 | |
| CN | 110294392 | A | * | 10/2019 | ..... B66B 13/00 |
| JP | S58151183 | U | | 10/1983 | |
| JP | H0420479 | A | | 1/1992 | |
| JP | H0485277 | A | | 3/1992 | |
| JP | H04345486 | A | | 12/1992 | |
| JP | H10129959 | A | | 5/1998 | |
| JP | 200529328 | A | | 2/2005 | |
| JP | 2006160420 | A | * | 6/2006 | |

(Continued)

*Primary Examiner* — Diem M Tran
(74) *Attorney, Agent, or Firm* — The Webb Law Firm

(57) ABSTRACT

The present invention includes a height raising member body mountable to an upper end of a frame disposed above an entrance of a car that moves up and down through an elevator shaft, in which a rail for guiding a car door in an opening and closing direction and a pulley for use in opening and closing drive of the car door are mounted to the frame. The height raising member body characteristically includes: a base part connectable to the frame; and a supporting part capable of supporting the motor at a position upward away from the base, the motor being configured to drive the pulley via a belt.

14 Claims, 20 Drawing Sheets

(56) References Cited

FOREIGN PATENT DOCUMENTS

| | | | | | |
|---|---|---|---|---|---|
| JP | 2006160420 | A | | 6/2006 | |
| JP | 2015168525 | A | | 9/2015 | |
| JP | 2016204089 | A | | 12/2016 | |
| JP | 6694608 | B1 | | 5/2020 | |
| KR | 200424446 | Y1 | * | 8/2006 | |
| WO | WO-2019224925 | A1 | * | 11/2019 | ..... B66B 13/08 |

* cited by examiner

HEIGHT RAISING MEMBER FOR RAISING MOUNTING POSITION OF MOTOR FOR ELEVATOR DOOR, CAR DOOR DEVICE EQUIPPED WITH HEIGHT RAISING MEMBER FOR RAISING MOUNTING POSITION OF MOTOR FOR ELEVATOR DOOR, AND ELEVATOR CAR EQUIPPED WITH HEIGHT RAISING MEMBER FOR RAISING MOUNTING POSITION OF MOTOR FOR ELEVATOR DOOR

CROSS-REFERENCE TO RELATED APPLICATIONS

This application claims priority to Japanese Patent Applications Nos. 2020-201557 filed Dec. 4, 2020 and 2021-080356 filed May 11, 2021, the disclosures of which are hereby incorporated by reference in their entirety.

BACKGROUND OF THE INVENTION

Field of the Invention

The present invention relates to a height raising member for raising a mounting position of a motor for an elevator door in order to dispose the motor above members disposed above an entrance of a car at a position away from the members, a car door device equipped with the height raising member for raising the mounting position of the motor for the elevator door, and an elevator car equipped with the height raising member for raising the mounting position of the motor for the elevator door.

Background of the Invention

Conventionally known is a car door device disposed at an entrance of a car and configured to open and close the entrance (see JP 6694608 B). Specifically, as shown in FIG. 19, the car door device includes: a door hanger 102 that holds a door panel 101 while allowing the door panel 101 to hang down therefrom; a frame 106 on which a rail 103 for guiding the door hanger 102 in an opening and closing direction of the door panel 101, and a pair of pulleys 105*a* and 105*b* around which a first endless belt 105 having the door hanger 102 connected thereto is wound are arranged; and a motor 108 configured to drive one pulley 105*a* out of the pair of pulleys 105*a* and 105*b* via a second endless belt 107. In this car door device 100, the motor 108 is mounted to the frame 106.

In the car door device 100 configured as above, the frame 106 with the door hanger 102 allowing the door panel 101 to hang down therefrom is arranged above an entrance 109*a* of a car 109. In the car door device 100 configured such that an output shaft 108*a* of the motor 108 and the one pulley 105*a* allow the second endless belt 107 to be wound therearound, the motor 108 projects from the frame 106 toward a rear side of the car 109. Thus, the car door device 100 generally has the motor 108 disposed to be positioned above a top board of the car 109.

In the case where the above car door device 100 is disposed to a car with a high ceiling, the frame (member) 106 with the motor 108 mounted thereto is disposed on an upper end of the car so as to allow the motor 108 to be located above the ceiling of the car even if the height of the entrance of the car does not nearly reach the height of the ceiling. In this case, since the rail 103 for guiding the door hanger 102 is also disposed on the frame 106, the door panel 101 having a larger height dimension is required, which causes a greater weight of the door panel 101 and thereby necessitates a larger motor 108. This consequently requires a larger space and a higher cost for disposing the car door device 100.

SUMMARY OF THE INVENTION

It is therefore an object of the present invention to provide a height raising member for raising a mounting position of a motor for an elevator door capable of suppressing the height dimension of a car door, a car door device equipped with the height raising member for raising the mounting position of the motor for the elevator door, and an elevator car equipped with the height raising member for raising the mounting position of the motor for the elevator door.

The following presents a simplified summary of the invention disclosed herein in order to provide a basic understanding of some aspects of the invention. This summary is not an extensive overview of the invention. It is intended to neither identify key or critical elements of the invention nor delineate the scope of the invention. Its sole purpose is to present some concepts of the invention in a simplified form as a prelude to the more detailed description that is presented later.

A height raising member for raising a mounting position of a motor for an elevator door, the height raising member according to the present invention includes: a height raising member body mountable to an upper end of a frame disposed above an entrance of a car that moves up and down through an elevator shaft, in which a rail for guiding a car door in an opening and closing direction and a pulley for use in opening and closing drive of the car door are mounted to the frame, the height raising member body including: a base part connectable to the frame; and a supporting part capable of supporting the motor at a position upward away from the base part, the motor being configured to drive the pulley via a belt.

The height raising member for raising the mounting position of the motor for the elevator door can be configured such that the height raising member body includes a distance adjusting part capable of adjusting a distance between the pulley and the motor.

The height raising member for raising the mounting position of the motor for the elevator door can be configured such that the height raising member body includes: a first member including the base part and an upwardly extending part extending upward from the base part; and a second member including the supporting part and a downwardly extending part extending downward from the supporting part, the second member being fixed to the first member with the downwardly extending part overlapping the upwardly extending part as viewed from a horizontal direction, and the distance adjusting part includes: at least one first long hole formed in the upwardly extending part and extending in a vertical direction; at least one second long hole formed in the downwardly extending part and extending in the vertical direction at a position at which the at least one second long hole at least partially overlaps the at least one first long hole; and at least one fixing member inserted through the at least one first long hole and the at least one second long hole to bring the downwardly extending part into engagement with the upwardly extending part in a relatively movable manner in the vertical direction, and to enable the downwardly extending part to be fixed to the upwardly extending part at a given relative position within a range based on the at least one first long hole and the at least one second long hole.

The height raising member for raising the mounting position of the motor for the elevator door can be configured such that a plurality of groups each of which includes the at least one first long hole, the at least one second long hole, and the at least one fixing member are disposed at intervals from each other in the horizontal direction.

The height raising member for raising the mounting position of the motor for the elevator door can include an extension member connectable to the base part of the height raising member body, and can be configured such that the upwardly extending part and the downwardly extending part have a flat plate shape overlapping each other in parallel with each other, the extension member includes: a first connecting part connectable to the frame; an extending part extending upward from the first connecting part; and a second connecting part disposed at a leading end of the extending part and connectable to the base part, and the extending part has a flat plate shape extending in a direction that crosses the upwardly extending part and the downwardly extending part as viewed from the vertical direction.

A car door device according to the present invention includes: a car door for opening and closing an entrance of a car that moves up and down through an elevator shaft; a frame part including: a frame disposed above the entrance of the car; a rail disposed on the frame and guiding the car door in an opening and closing direction; and a pulley disposed to the frame and for use in opening and closing drive of the car door; the aforementioned height raising member for raising the mounting position of the motor for the elevator door; and the motor supported by the height raising member for raising the mounting position of the motor for the elevator door, the motor being configured to drive the pulley via a belt.

The car door device can be configured such that the frame includes: a frame body having a plate shape extending in a vertical direction and the opening and closing direction above the entrance of the car, and having an upper end linearly extending along the opening and closing direction; and a flange part having a plate shape and extending from the upper end of the frame body in the opening and closing direction and to a rear side of the car, and the height raising member for raising the mounting position of the motor for the elevator door includes: a bracket including: an angle part having an L shape in cross section and including a first portion extending along the flange part and a second portion extending along the frame body; and at least one rib connecting the first portion and the second portion to each other to maintain an angle of the second portion to the first portion; at least one first connecting member that connects the first portion and the base part of the height raising member to each other with the flange part sandwiched between the first portion and the base part; and at least one second connecting member that connects the second portion and the frame body to each other.

A height raising member for raising a mounting position of a motor for an elevator door according to the present invention includes: a height raising member body mountable to an upper end of at least one base member extending in an opening and closing direction above a frame disposed above an entrance of a cage, the frame including: a rail for guiding a car door in the opening and closing direction; and a pulley for use in opening and closing drive of the car door, the height raising member body including: a base part connectable to the at least one base member; and a supporting part capable of supporting the motor at a position upward away from the base part, the motor being configured to drive the pulley via a belt.

The height raising member for raising the mounting position of the motor for the elevator door can be configured such that the height raising member body includes: a first member including the base part connectable to the at least one base member and an upwardly extending part extending upward from the base part; a second member including the supporting part capable of supporting the motor at the position upward away from the base part and a downwardly extending part extending downward from the supporting part, the second member being fixed to the first member with the downwardly extending part overlapping the upwardly extending part as viewed from a horizontal direction; and a distance adjusting part capable of adjusting a distance between the pulley and the motor, and the distance adjusting part includes: at least one first long hole formed in the upwardly extending part and extending in a vertical direction; at least one second long hole formed in the downwardly extending part and extending in the vertical direction at a position at which the at least one second long hole at least partially overlaps the at least one first long hole; and at least one fixing member inserted through the at least one first long hole and the at least one second long hole to bring the downwardly extending part into engagement with the upwardly extending part in a relatively movable manner in the vertical direction, and to enable the downwardly extending part to be fixed to the upwardly extending part at a given relative position within a range based on the at least one first long hole and the at least one second long hole.

The height raising member for raising the mounting position of the motor for the elevator door can be configured such that a plurality of groups each of which includes the at least one first long hole, the at least one second long hole, and the at least one fixing member are disposed at intervals from each other in the horizontal direction.

The height raising member for raising the mounting position of the motor for the elevator door can be configured such that a plurality of the fixing members are inserted to the at least one first long hole and the at least one second long hole that are at least partially overlapping each other.

The height raising member for raising the mounting position of the motor for the elevator door can be configured such that the height raising member body includes: a supporting part connecting part connected to the supporting part; and a motor connecting part extending upward from the supporting part connecting part and to which an end of the motor on a side of an output shaft is connectable.

The height raising member for raising the mounting position of the motor for the elevator door can be configured such that the height raising member body includes: a first member including the base part connectable to the at least one base member and an upwardly extending part extending upward from the base part; a second member extending in a vertical direction and including the supporting part capable of supporting the motor at the position upward away from the base part, the second member being fixed to the first member with the supporting part overlapping the upwardly extending part as viewed from a horizontal direction; a distance adjusting part capable of adjusting a distance between the pulley and the motor, and the distance adjusting part includes: at least one first long hole formed in the upwardly extending part and extending in the vertical direction; at least one second long hole formed in the supporting part and extending in the vertical direction at a position at which the at least one second long hole at least partially overlaps the at least one first long hole; and at least one fixing member inserted through the at least one first long hole and the at least one second long hole to bring the supporting part into engagement with the upwardly extending part in a relatively movable manner in the vertical direction, and to enable the supporting part to be fixed to the upwardly extending part at a given relative position within a range based on the at least one first long hole and the at least one second long hole.

The height raising member for raising the mounting position of the motor for the elevator door can be configured such that two groups each of which includes the at least one first long hole, the at least one second long hole, and the at least one fixing member are disposed with a distance therebetween in the opening and closing direction, the upwardly extending part has a recessed opening recessed downward from an upper end of the upwardly extending part between the two first long holes, and the supporting part has a hole between the two second long holes, and is capable of fixing thereto an end of the motor on a side of an output shaft, with the output shaft of the motor projecting through the hole.

An elevator car according to the present invention includes: a car door; a frame including a rail for guiding the car door in an opening and closing direction, and a pulley for use in opening and closing drive of the car door; a cage having an entrance and having the frame disposed above the entrance; at least one base member extending in the opening and closing direction above the frame; the aforementioned height raising member for raising the mounting position of the motor for the elevator door; and the motor supported by the height raising member for raising the mounting position of the motor for the elevator door, the motor being configured to drive the pulley via a belt, in which the height raising member for raising the mounting position of the motor for the elevator door is mounted to an upper end of the at least one base member.

The elevator car can include a car frame supporting the cage, and can be configured such that the at least one base member is a member forming a part of the car frame, or is a member disposed on a ceiling wall of the cage.

The elevator car can be configured such that the at least one base member includes: a body having a plate shape extending in a vertical direction and the opening and closing direction above the frame, and having an upper end linearly extending along the opening and closing direction; and a flange part having a plate shape and extending from the upper end of the body in the opening and closing direction and to a rear side of the cage, and the height raising member for raising the mounting position of the motor for the elevator door includes: a bracket including: an angle part having an L shape in cross section and including a first portion extending along the flange part and a second portion extending along the body; and at least one rib connecting the first portion and the second portion to each other to maintain an angle of the second portion to the first portion; at least one first connecting member that connects the first portion and the base part of the height raising member to each other with the flange part sandwiched between the first portion and the base part; and at least one second connecting member that connects the second portion and the base member to each other.

BRIEF DESCRIPTION OF DRAWINGS

The foregoing and other features of the present invention will become apparent from the following description and drawings of an illustrative embodiment of the invention in which.

DESCRIPTION OF THE INVENTION

A description will be hereinafter given on a first embodiment of the present invention, with reference to FIG. 1 to FIG. 5B.

Figure 1:
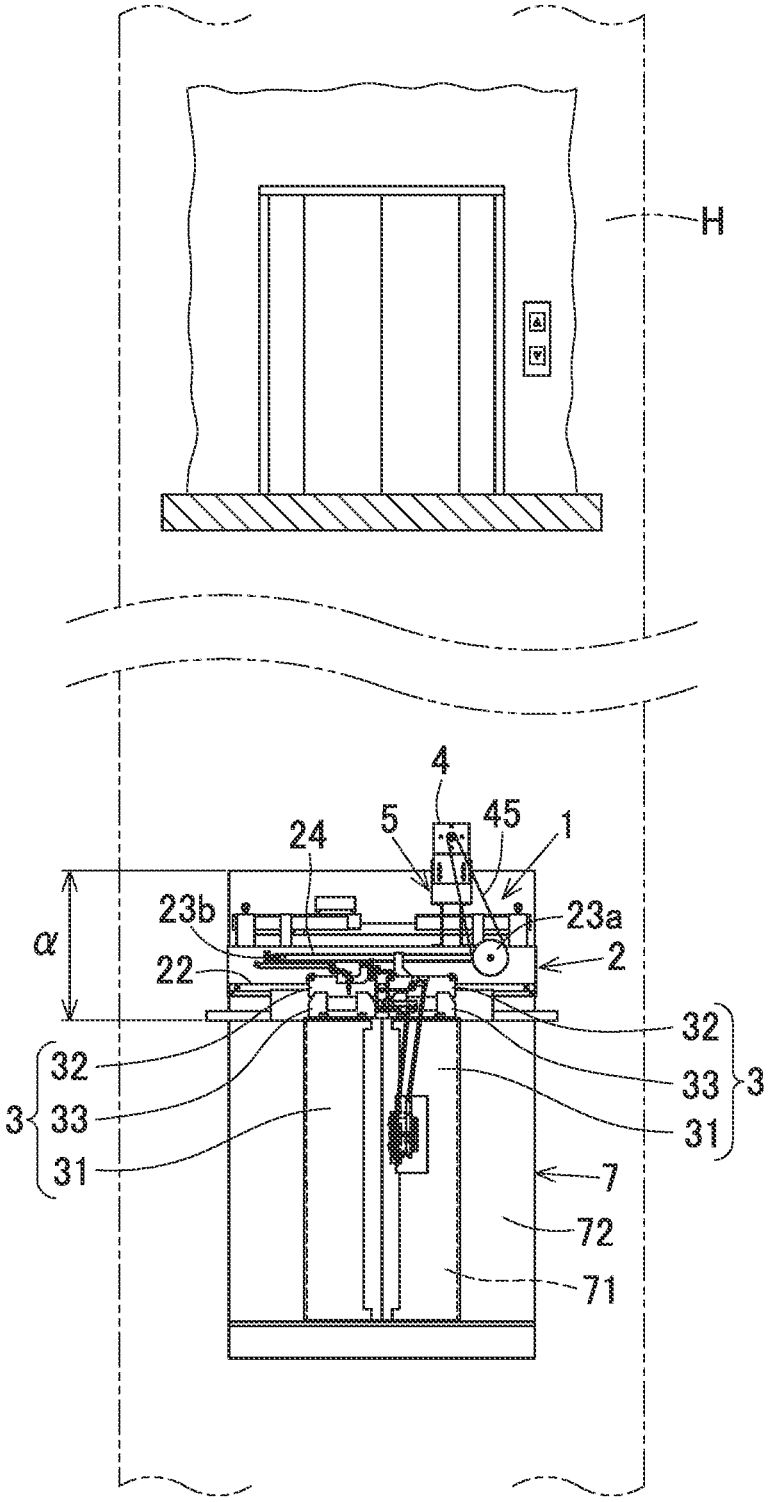
FIG. 1 is a schematic view of an elevator according to a first embodiment of the present invention.

As shown in FIG. 1, a car door device 1 for an elevator is disposed at an entrance 71 of a car 7 that moves up and down through an elevator shaft H. Specifically, the car door device 1 includes: a frame part 2 disposed above the entrance 71 of the car 7; at least one car door 3 that opens and closes the entrance 71 of the car 7; a motor 4 for opening and closing the at least one car door 3; and a height raising member for raising a mounting position of a motor for an elevator door, (hereinafter referred also to simply as "height raising member") for supporting the motor 4. The car door device 1 of this embodiment is a so-called center-open type car door device having two car doors 3.

As shown in FIG. 2 to FIG. 5B, the frame part 2 includes: a frame 21 disposed at a position above the entrance 71 on an outer surface of a front wall 72 of the car 7; a rail 22 for guiding the car doors 3 in their opening and closing direction (hereinafter referred also to simply as "opening and closing direction"); a pair of pulleys 23*a* and 23*b* disposed on the frame 21 with a distance therebetween in the opening and closing direction; and a first endless belt 24 wound around the pair of pulleys 23*a* and 23*b*.

The frame 21 includes: a frame body 211 having a plate shape extending in a vertical direction and the opening and closing direction and having an upper end 211*t* linearly extending along the opening and closing direction; and a flange part 212 extending from the upper end 211*t* of the frame body 211 to a rear side in an entrance direction of the car 7 (hereinafter referred also to simply as "entrance direction"). In the frame 21 of this embodiment, the frame body 211 and the flange part 212 are formed by bending an end portion of one metal plate.

The frame body 211 is a plate-shaped portion having the upper end 211*t* linearly extending along the opening and closing direction. The frame body 211 of this embodiment has a rectangular plate shape elongated in the opening and closing direction. At least the rail 22 and the pair of pulleys 23*a* and 23*b* are mounted to the frame body 211.

The upper part of the frame body 211 has a plurality of holes 211*a* aligned at intervals from each other in the opening and closing direction. Each of the plurality of holes 211*a* is a long hole extending in the opening and closing direction. Some of the plurality of holes 211*a* are disposed at a position on one end side and the others are disposed at a position on the other end side in the opening and closing direction with respect to the center of the frame body 211.

The frame body 211 of this embodiment has two groups 211A each having three holes 211*a*. The two groups 211A are disposed respectively at the positions on the one end side and the other end side in the opening and closing direction with respect to the center of the frame body 211. In the frame body 211, the groups 211A share the same distance in the opening and closing direction from the center position thereto. The plurality of holes 211*a* forming each group 211A are aligned at equal intervals from each other in the opening and closing direction.

The flange part 212 is a plate-shaped portion extending from the upper end 211*t* of the frame body 211 both in the opening and closing direction and to the rear side in the entrance direction. The flange part 212 has a strip plate shape that has a constant or a substantially constant dimension in the entrance direction (i.e., width) at any position in the opening and closing direction of the flange part 212 and that is elongated in the opening and closing direction. The flange part 212 of this embodiment has a width of about 50 mm to 90 mm, and has a dimension in the opening and closing direction (i.e., length) that is shorter than that of the frame body 211.

Figure 5A:
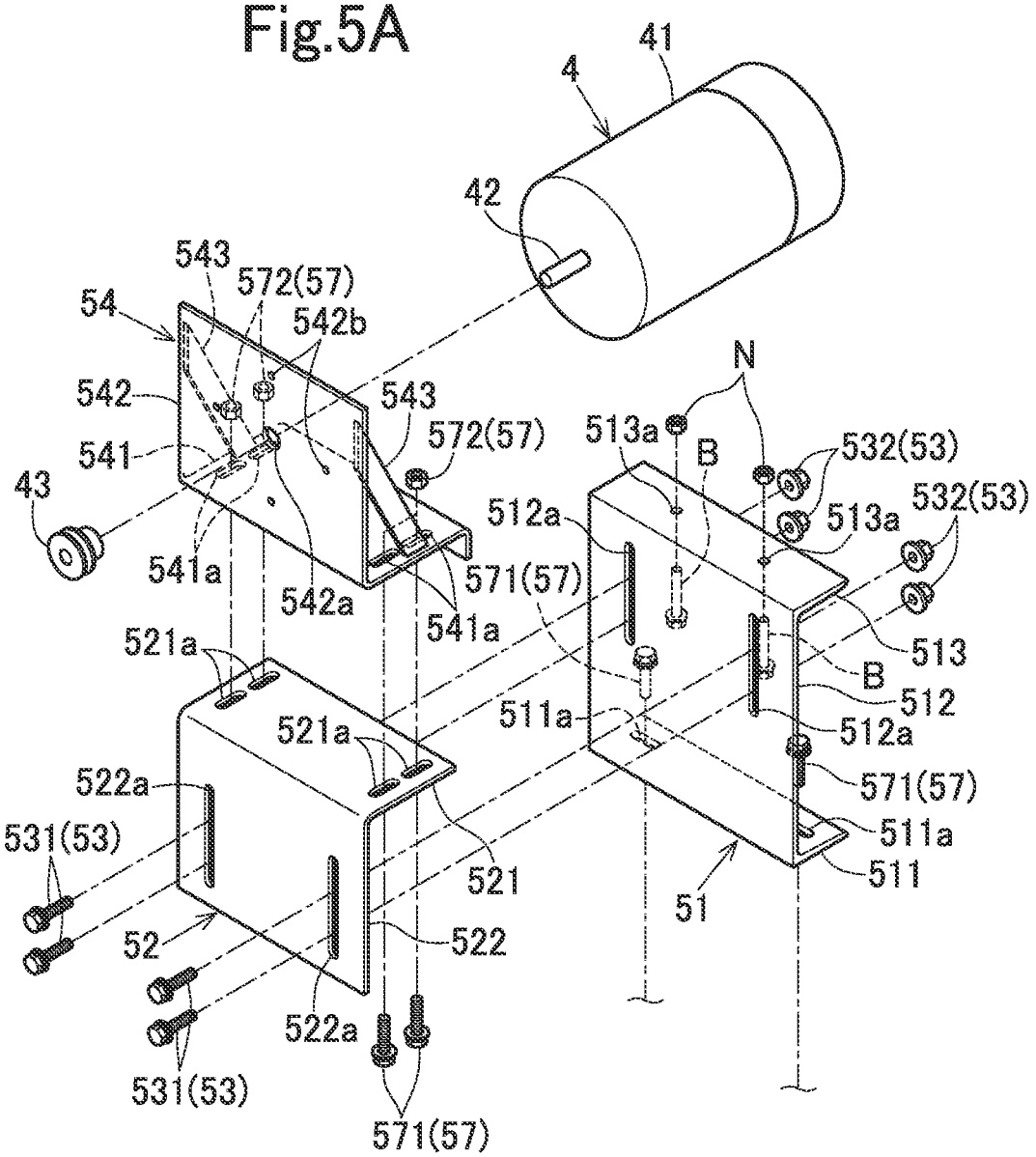
FIG. 5A is an enlarged view of a height raising member body and the motor in FIG. 4.
Figure 5B:
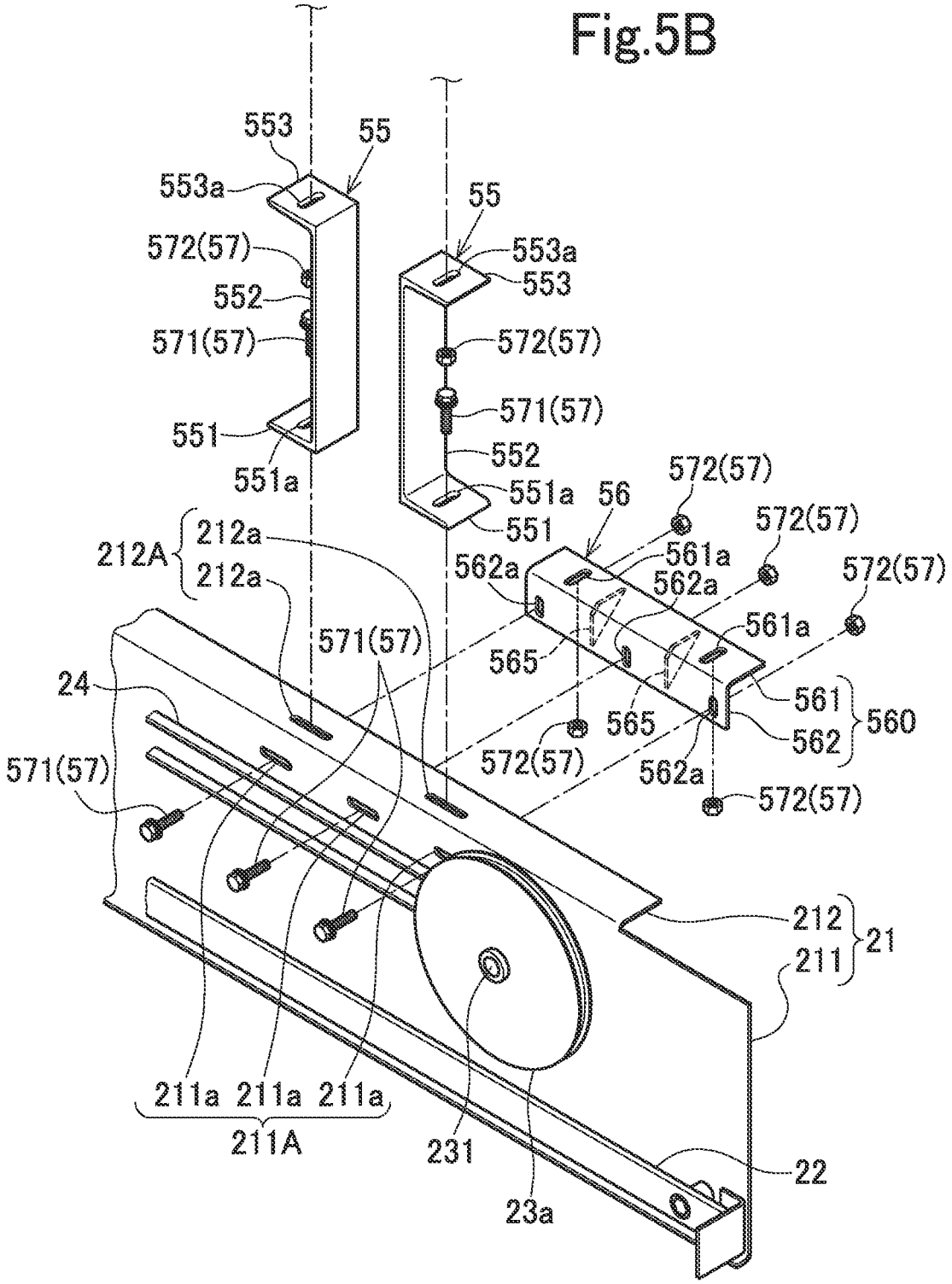
FIG. 5B is an enlarged view of a frame and an extension member in FIG. 4.

The flange part 212 has a plurality of holes 212*a* aligned at intervals from each other in the opening and closing direction (see FIG. 5B). Each of the plurality of holes 212*a* is a long hole extending in the opening and closing direction. The flange part 212 of this embodiment has two groups 212A each having two holes 212*a*, and each of the two groups 212A is disposed in an area (position) corresponding in the opening and closing direction to the area of the frame body 211 in which the corresponding one of the groups 211A of the frame body 211 is disposed. That is, the two groups 212A are disposed respectively at the positions on the one end side and the other end side in the opening and closing direction with respect to the center of the frame body 211.

The rail 22 is disposed on the frame body 211 of the frame 21 (specifically, on a lower end portion of the frame body 211). The rail 22 extends in the opening and closing direction at a position above the entrance 71 of the car 7. The rail 22 of this embodiment guides each of the two car doors 3.

The pair of pulleys 23*a* and 23*b* are disposed with a distance therebetween in the opening and closing direction at a position above the rail 22 in the frame body 211. More specifically, in the frame body 211, the pulleys 23*a* and 23*b* respectively have rotary shafts 231 extending in the entrance direction at the same height as each other and located outside in the opening and closing direction of the entrance 71. The pulleys 23*a* and 23*b* are mounted to the frame body 211 in a manner rotatable about the respective rotary shafts 231. One pulley 23*a* out of the pair of pulleys 23*a* and 23*b* of this embodiment is a so-called two stage pulley having two winding portions around which the endless belts 24 and 25 can be wound. These two winding portions have different diameters from each other. The one pulley 23*a* is disposed outside in the opening and closing direction of the height raising member 5. The other pulley 23*b* has a winding portion having a diameter that is the same as the diameter of the smaller diameter winding portion of the one pulley 23*a*.

Each of the two car doors 3 includes: a door panel 31 having a rectangular plate shape; a door hanger 32 guided by the rail 22 while allowing the door panel 31 to hang down therefrom; and an intermediate member 33 connecting the door hanger 32 and the door panel 31 to each other. The door panel 31 of this embodiment has a rectangular shape elongated in the vertical direction. The door hangers 32 are connected to the first endless belt 24. Specifically, the door hanger 32 of one of the two car doors 3 is connected to an upper one of two upper and lower belt segments (i.e., a segment of the first endless belt 24) spanning between the pair of pulleys 23*a* and 23*b*, while the door hanger 32 of the other one of the two car doors 3 is connected to the lower segment of the belt 24. This configuration allows the two car doors 3 to operate simultaneously with each other for opening and closing. That is, when one of the two car doors 3 moves for opening and closing operation, the other one of the two car doors 3 also moves for opening and closing operation in association with (synchronously with) the opening and closing operation of the one of the two car doors 3.

The motor 4 includes: a motor body 41; an output shaft 42 projecting from the motor body 41 and outputting rotative power; and a pulley 43 mounted to the output shaft 42. The motor 4 is disposed to have the output shaft 42 directed to a front side in the entrance direction and extending in a direction corresponding to the entrance direction of the car 7 (i.e., front-back direction). A second endless belt (belt) 45 is wound around the pulley 43 of the motor 4 and the pulley 23*a* disposed on the frame 21. This configuration allows the rotative power output from the output shaft 42 of the motor 4 to be transmitted to the pulley 23*a* of the frame 21 via the second endless belt 45.

In the car door device 1 of this embodiment, the pair of pulleys 23*a* and 23*b*, the first endless belt 24, the motor 4, and the second endless belt 45 form the drive mechanism of the car doors 3.

The height raising member 5 includes a height raising member body 50 (see FIG. 4) mountable to an upper end of the frame 21, and the height raising member body 50 includes: a base part 511 connectable to the frame 21; and a supporting part 521 capable of supporting the motor 4 at a position upward away from the base part 511, the motor 4 being configured to drive the pulley 23*a* via the second endless belt (belt) 45.

Specifically, the height raising member 5 includes: the height raising member body 50 supporting the motor 4; and at least one extension member 55 that can be disposed between the frame 21 and the height raising member body 50. The height raising member 5 of this embodiment further includes a bracket 56 that fixes the height raising member body 50 or the extension member 55 to the frame 21 and that can secure the strength of the frame 21. The height raising member 5 further includes a plurality of connecting members 57 for connecting members to each other. The plurality of connecting members 57 of this embodiment include bolts 571, or include bolts 571 and nuts 572 screwed with the bolts 571.

Figure 2:
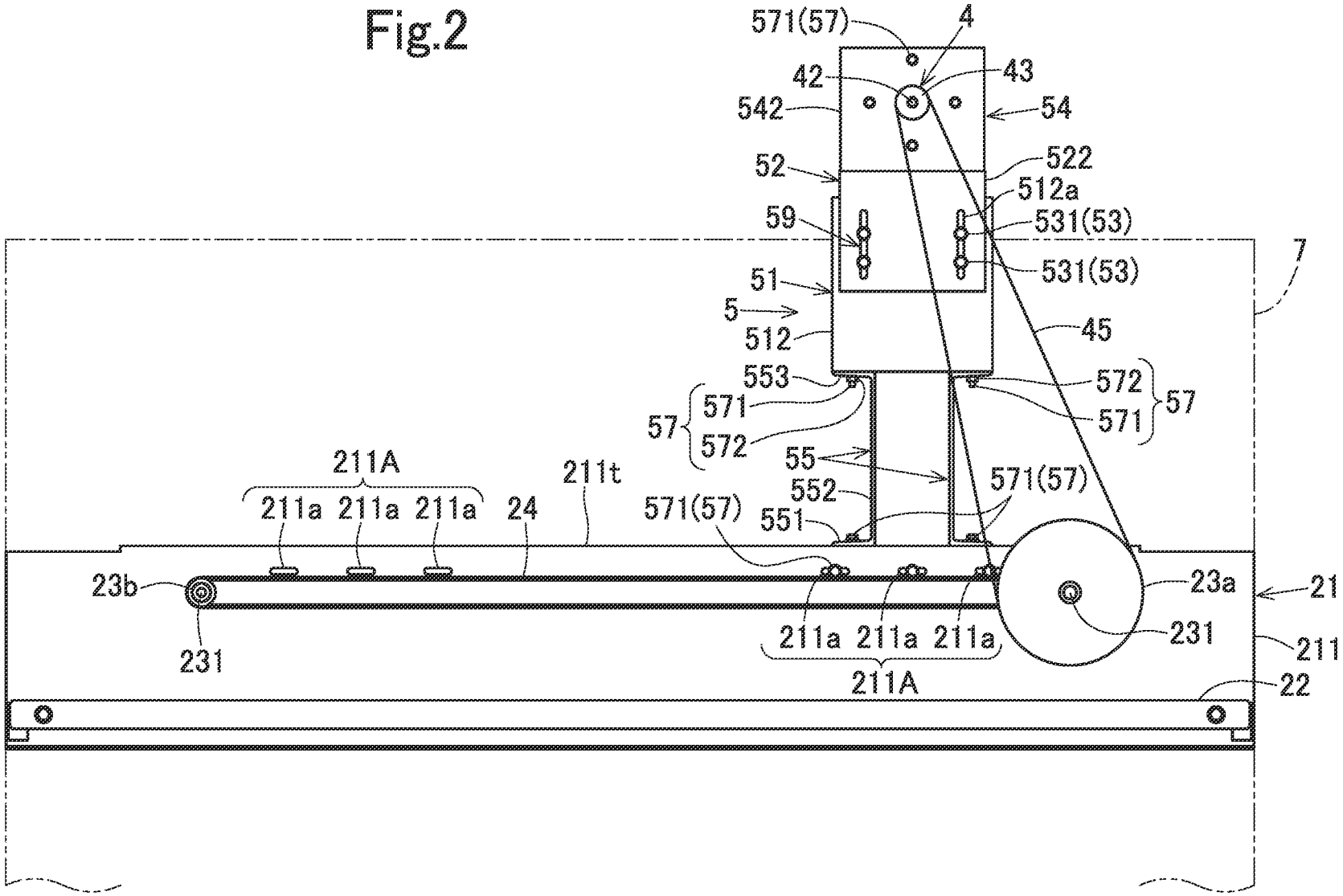
FIG. 2 is a front view of a car door device equipped with a height raising member for raising a mounting position of a motor for an elevator door, with some configurations thereof omitted.
Figure 3:
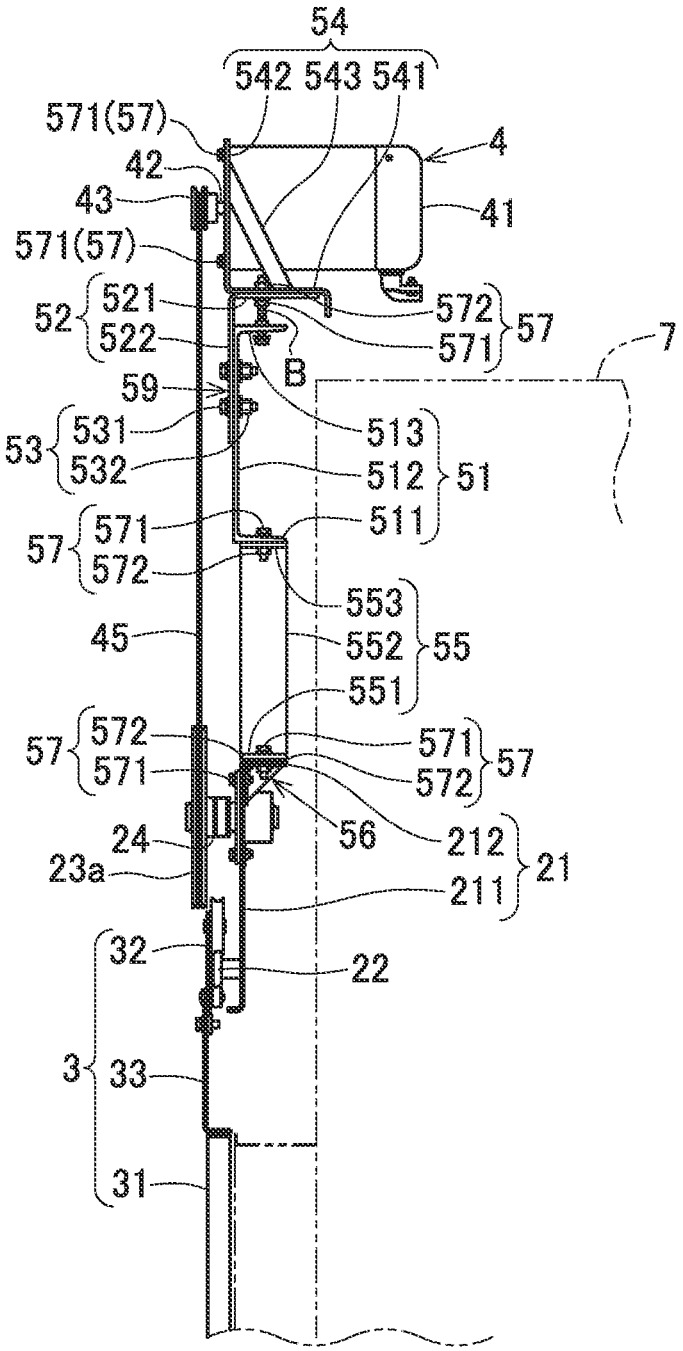
FIG. 3 is a side view of the car door device.

The height raising member body 50 includes a distance adjusting part 59 capable of adjusting a distance between the pulley 23*a* and the motor 4, specifically, a distance between the pulley 23*a* and the pulley 43 of the motor 4 (see FIG. 2). Specifically, the height raising member body 50 includes: a first member 51 connectable to the frame 21; a second member 52 capable of moving relative to the first member 51; and at least one fixing member 53 fixing the second member 52 to the first member 51. The height raising member body 50 of this embodiment includes a motor connecting member 54 that connects the motor 4 and the second member 52 to each other. The height raising member body 50 of this embodiment includes at least one push up member B capable of pushing the second member 52 upward relative to the first member 51.

The first member 51 includes: the base part 511 connectable to the frame 21; and an upwardly extending part 512 extending upward from the base part 511. The base part 511 of this embodiment is connected to the frame 21 via the extension member 55. That is, the base part 511 is connected to the extension member 55. The first member 51 further includes a flange part 513 extending from a leading end of the upwardly extending part 512 toward the rear side of the car 7.

The base part 511 is a plate-shaped portion extending in the opening and closing direction and the entrance direction, and has a plurality of holes 511*a* penetrating therethrough in the vertical direction. The plurality of holes 511*a* are disposed at intervals from each other in the opening and closing direction, and each of the plurality of holes 511*a* is a long hole extending in the opening and closing direction. The base part 511 of this embodiment has a rectangular plate shape elongated in the opening and closing direction, and has two holes 511*a*.

The upwardly extending part 512 is a plate-shaped (flat plate-shaped) portion extending upward from the base part 511. Specifically, the upwardly extending part 512 has a rectangular plate shape extending in the opening and closing direction and the vertical direction, and has at least one first long hole 512*a* penetrating therethrough in its thickness direction and extending in the vertical direction. This upwardly extending part 512 extends upward from a front side end in the entrance direction of the base part 511. The upwardly extending part 512 of this embodiment has a plurality of first long holes 512*a*, which are disposed at intervals from each other in the opening and closing direction. More specifically, the upwardly extending part 512 has two first long holes 512*a*.

The flange part 513 is a plate-shaped portion extending in the opening and closing direction and the entrance direction, and has a plurality of holes 513*a* penetrating therethrough in the vertical direction. The plurality of holes 513*a* are disposed at intervals from each other in the opening and closing direction. The flange part 513 of this embodiment has a rectangular plate shape elongated in the opening and closing direction, and has two holes 513*a*. The flange part 513 extends from the upper end of the upwardly extending part 512 to the rear side in the entrance direction. Each of the two holes 513*a* is a screw hole (tapped hole) having internal threads formed on its inner circumferential surface.

The second member 52 includes: the supporting part 521 supporting the motor 4; and a downwardly extending part 522 extending downward from the supporting part 521, and is fixed to the first member 51 with the downwardly extending part 522 overlapping the upwardly extending part 512 as viewed from the horizontal direction.

The supporting part 521 has a plate shape extending in the opening and closing direction and the entrance direction, and has a plurality of holes 521*a* penetrating therethrough in the vertical direction. In the supporting part 521, a plurality of (two in the example of this embodiment) holes 521*a* aligned in the entrance direction form one row, a plurality of which (two rows in the example of this embodiment) are disposed at intervals from each other in the opening and closing direction. The plurality of holes 521*a* forming each of the plurality of rows are long holes extending in the entrance direction. Each of the plurality of holes 521*a* is disposed at a position not overlapping each of the holes 513*a* of the flange part 513 of the first member 51 as viewed from the vertical direction.

The downwardly extending part 522 is a plate-shaped (flat plate-shaped) portion extending downward from the supporting part 521, and overlaps the upwardly extending part 512 of the first member 51 in parallel with each other. Specifically, the downwardly extending part 522 has a rectangular plate shape extending in the opening and closing direction and the vertical direction, and has at least one second long hole 522*a* penetrating therethrough in its thickness direction. The at least one second long hole 522*a* extends in the vertical direction at a position at which it at least partially overlaps one of the first long holes 512*a* of the upwardly extending part 512. More specifically, the at least one second long hole 522*a* is disposed at a position that is the same as the position in the opening and closing direction of a corresponding one of the first long holes 512*a* (through which the common fixing member 53 is inserted) and at a position at which it at least partially overlaps the first long hole 512*a* in the vertical direction. The downwardly extending part 522 of this embodiment has the second long hole 522*a* at a position corresponding to one of the plurality of first long holes 512*a*. That is, in the downwardly extending part 522, a plurality of second long holes 522*a* are disposed at intervals from each other in the opening and closing direction. More specifically, the downwardly extending part 522 has two second long holes 522*a*.

The at least one fixing member 53 can be inserted through one of the first long holes 512*a* and the second long hole 522*a* corresponding to (overlapping) the first long hole 512*a* to thereby bring the downwardly extending part 522 into engagement with the upwardly extending part 512 in a relatively movable manner in the vertical direction, and to enable the downwardly extending part 522 to be fixed to the upwardly extending part 512 at a given relative position within a range based on the first long hole 512*a* and the second long hole 522*a* through which the at least one fixing member 53 is inserted. The height raising member body 50 of this embodiment includes a plurality of fixing members 53.

Specifically, each of the plurality of fixing members 53 includes: a bolt 531 inserted through the corresponding first long hole 512*a* and second long hole 522*a*; and a nut 532 screwed with the bolt 531. The bolt 531 inserted through the first long hole 512*a* and the second long hole 522*a* overlapping each other as viewed from the entrance direction brings the upwardly extending part 512 and the downwardly extending part 522 into engagement with each other so as to allow the downwardly extending part 522 to be relatively movable in the vertical direction (i.e., the direction in which the first long hole 512*a* or the second long hole 522*a* extends) relative to the upwardly extending part 512. At this time, the range within (i.e., the distance over) which the downwardly extending part 522 is relatively movable in the vertical direction relative to the upwardly extending part 512 is defined by the dimensions in the vertical direction of the first long hole 512*a* and the second long hole 522*a*. When the downwardly extending part 522 reaches a certain position relative to the upwardly extending part 512, the nut 532 screwed with the bolt 531 is fastened to thereby allow the downwardly extending part 522 to be fixed to the upwardly extending part 512 at the certain position. The two nuts 532 can be substituted by a plate nut having two screw holes (tapped holes).

In the height raising member body 50 (height raising member 5) of this embodiment, the distance adjusting part 59 is formed by the first long holes 512*a* and the second long holes 522*a* overlapping each other, and the fixing members 53 inserted through the first long holes 512*a* and the second long holes 522*a*. In the height raising member body 50 of this embodiment, two fixing members 53 (specifically, two bolts 531) are inserted through the first long hole 512*a* and the second long hole 522*a* overlapping each other. A plurality of groups each of which includes these two fixing members 53, and the first long hole 512*a* and the second long hole 522*a* through which the two fixing members 53 are inserted are disposed at intervals from each other in the horizontal direction. More specifically, two groups are disposed with a distance therebetween in the opening and closing direction.

The motor connecting member 54 includes: a supporting part connecting part 541 having a plate shape extending in the opening and closing direction and the entrance direction; a motor connecting part 542 extending upward from a front side end in the entrance direction of the supporting part connecting part 541; and at least one reinforcing part 543 connecting the supporting part connecting part 541 and the motor connecting part 542 to each other.

The supporting part connecting part 541 has a rectangular plate shape, with a rear side end portion in the entrance direction being bent downward. The supporting part connecting part 541 has holes 541*a* at positions corresponding to the respective holes 521*a* of the supporting part 521 of the second member 52. That is, a plurality of (two in the example of this embodiment) holes 541*a* aligned in the entrance direction form one row, a plurality of which (two rows in the example of this embodiment) are disposed at intervals from each other in the opening and closing direction. The plurality of holes 541*a* forming each of the plurality of rows are long holes extending in the entrance direction. The supporting part connecting part 541 is connected (fixed) to the supporting part 521 while overlapping the supporting part 521 of the second member 52, by the connecting members 57 (i.e., the bolts 571 and the nuts 572) inserted through the respective holes 541*a* and the corresponding ones of the holes 521*a* of the supporting part 521.

The motor connecting part 542 has a rectangular plate shape extending in the vertical direction and the opening and closing direction, and has a hole 542*a* at a central portion. The motor connecting part 542 further has a plurality of holes 542*b* around the hole 542*a*. The hole 542*a* at the central portion has a larger diameter than the diameter of each of the plurality of holes 542*b* disposed around the hole 542*a*.

The at least one reinforcing part 543 connects a rear portion of the supporting part connecting part 541 and an upper portion of the motor connecting part 542 to each other at an end in the opening and closing direction of the motor connecting member 54. The at least one reinforcing part 543 of this embodiment has a strip plate shape extending in a direction inclined to both the supporting part connecting part 541 and the motor connecting part 542.

Figure 4:
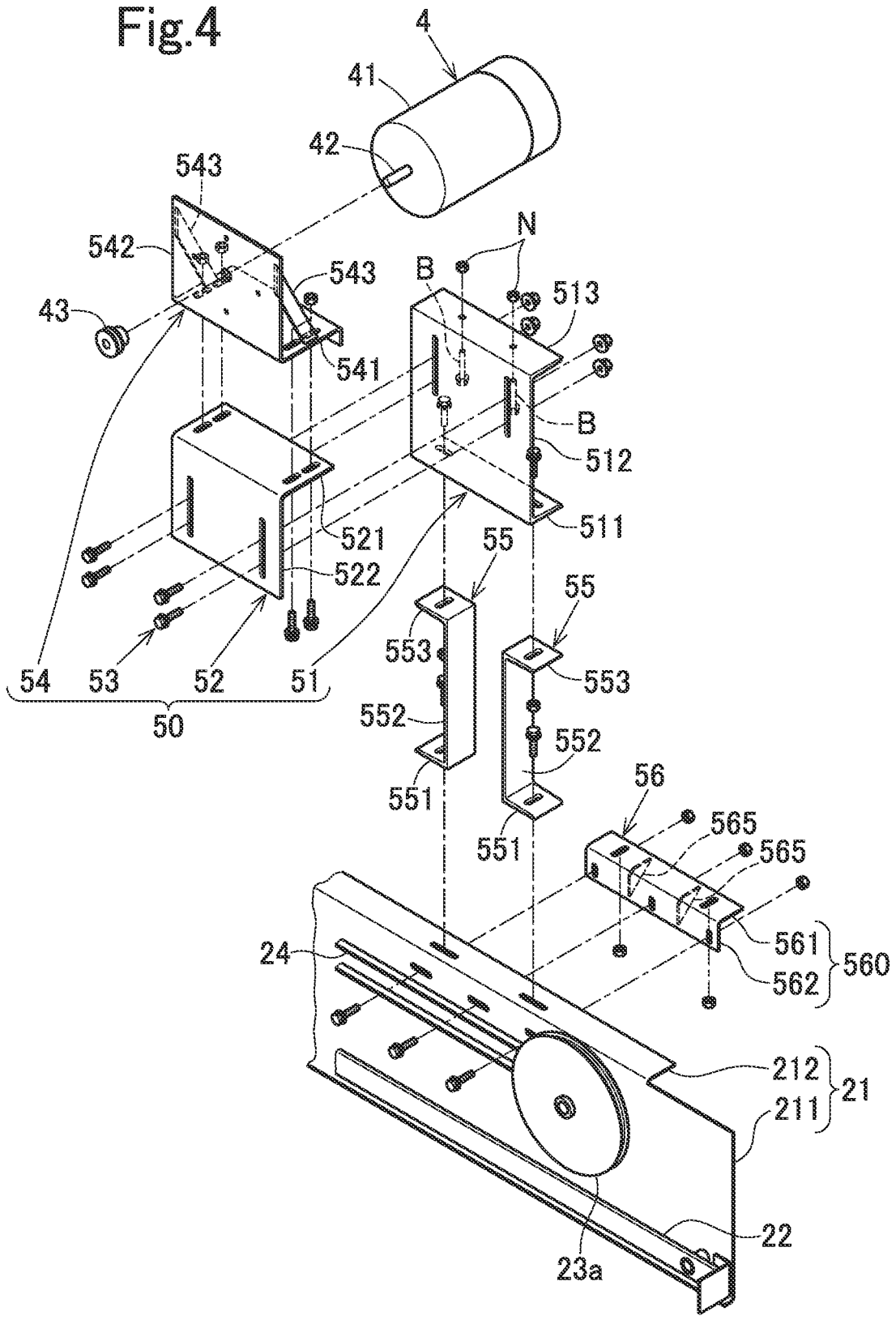
FIG. 4 is an exploded perspective view of the height raising member for raising the mounting position of the motor for the elevator door, and members and parts therearound.

In the motor connecting member 54, the fore part of the motor 4 (i.e., the part of the motor 4 through which the output shaft 42 projects) is connected to the motor connecting part 542 by the connecting members 57 (specifically the bolts 571: see FIG. 3) inserted through the respective holes 542*b* of the motor connecting part 542, in the state where the output shaft 42 projects to the front side in the entrance direction through the hole 542*a* of the motor connecting part 542. In this state, a rear end in the entrance direction of the supporting part 521 of the second member 52 is located more on the front side than the central position of the motor body 41. That is, the motor 4 is connected (disposed) to the height raising member body 50 by the motor connecting member 54 so as to allow the rear portion of the motor 4 to greatly project in the entrance direction from the height raising member 5. In FIG. 4 and FIG. 5A, the illustration of the connecting members 57 (bolts 571) for connecting the motor 4 to the motor connecting part 542 is omitted for the sake of facilitating the viewing of the figures.

The at least one push up member B is a jack-up bolt inserted upward through the hole 513*a* of the flange part 513 of the first member 51. After the fixing members 53 are loosened to unfix the second member 52 from the first member 51, the at least one push up member B having the shaft with external threads formed on its circumferential surface is caused to rotate about the shaft while the leading end of the shaft is held in contact with the supporting part 521 of the second member 52, so that the position in the vertical direction of the second member 52 relative to the first member 51 (i.e., the distance in the vertical direction between the flange part 513 and the supporting part 521) can be adjusted. The height raising member body 50 of this embodiment includes a plurality of push up members B.

Specifically, in order to allow the motor 4 to ascend, the respective push up members B are caused to rotate about their shafts for ascending while the second member 52 is unfixed from the first member 51, so that the leading ends of the respective push up members B held in contact with the supporting part 521 (second member 52) push up the supporting part 521. The motor 4 thereby ascends. In order to allow the motor 4 to descend, on the other hand, the respective push up members B are caused to rotate about their shafts (in the inverse rotation direction of the direction when the motor 4 ascends) for descending while the second member 52 is unfixed from the first member 51, so that the motor 4, the motor connecting member 54, and the supporting part 521 descend by their own weight together with the push up members B while the supporting part 521 is supported by (i.e., held in contact with) the leading ends of the respective push up members B. The motor 4 thereby descends.

When the second member 52 reaches a desired height position (relative position) relative to the first member 51, the fixing members 53 (i.e., bolts 531 and nuts 532) are fastened to fix the second member 52 to the first member 51. Further, fastening members (nuts in the example of this embodiment) N screwed with the respective push up members B are fastened to also fix these push up members B. That is, the fastening members N play a role as double nuts.

The at least one extension member 55 includes: a first connecting part 551 connectable to the frame 21; an extending part 552 extending upward from the first connecting part 551; and a second connecting part 553 disposed at a leading end of the extending part 552 and connectable to the base part 511 of the height raising member body 50. In this embodiment, a plurality of (two in the example of this embodiment) extension members 55 are disposed at intervals from each other in the opening and closing direction. Each of the plurality of extension members 55 of this embodiment has a dimension in the vertical direction equal to the dimension in the vertical direction of the first member 51.

The first connecting part 551 is a plate-shaped portion extending in the opening and closing direction and the entrance direction. The first connecting part 551 of this embodiment has a rectangular plate shape, and has at least one hole 551*a* penetrating therethrough in the vertical direction. The at least one hole 551*a* is a long hole extending in the entrance direction. The first connecting part 551 has a dimension in the entrance direction equal to the dimension in the entrance direction of the flange part 212 of the frame 21.

The extending part 552 has a plate shape (flat plate shape) extending in a direction crossing the upwardly extending part 512 and the downwardly extending part 522 as viewed from the vertical direction. Specifically, the extending part 552 has a plate shape extending in the entrance direction and the vertical direction. That is, the extending part 552 has a plate shape extending in a direction orthogonal to the upwardly extending part 512 and the downwardly extending part 522 as viewed from the vertical direction. The extending part 552 extends upward from an end in the opening and closing direction of the first connecting part 551. The extending part 552 of this embodiment has a rectangular shape elongated in the vertical direction, and extends upward from an end on an inner side (on a side closer to the other extension member 55) in the opening and closing direction of the first connecting part 551. The extending part 552 has a dimension in the entrance direction equal to the dimension in the entrance direction of the first connecting part 551.

The second connecting part 553 is a plate-shaped portion extending in the opening and closing direction and the entrance direction. The second connecting part 553 of this embodiment has a rectangular plate shape extending to an outer side (the opposite side to the other extension member 55) from the upper end of the extending part 552, and has at least one hole 553*a* penetrating therethrough in the vertical direction. The at least one hole 553*a* is a long hole extending in the entrance direction. The second connecting part 553 has a dimension in the entrance direction equal to the dimension in the entrance direction of the extending part 552. The second connecting part 553 is connected (fixed) to the base part 511 while overlapping the base part 511 of the first member 51, by the connecting members 57 (bolts 571 and nuts 572) inserted through the respective holes 553*a* and the corresponding ones of the holes 511*a* of the base part 511.

The bracket 56 includes an angle part 560 extending in the opening and closing direction, and at least one rib 565 disposed to the angle part 560. The bracket 56 is disposed on the inner side of the frame 21 (i.e., the side of the car 7) along the upper end of the frame 21, specifically along the upper end of the frame body 211 and the flange part 212 (see FIG. 3). The bracket 56 of this embodiment includes a plurality of ribs 565.

The angle part 560 is a portion having an L shape in cross section and including a first portion 561 extending along the flange part 212 and a second portion 562 extending along the frame body 211. Each of the first portion 561 and the second portion 562 of this embodiment has a rectangular plate shape elongated in the opening and closing direction.

The first portion 561 has a plurality of holes 561*a* corresponding in number to the number of holes 212*a* of the flange part 212 of the frame 21. The plurality of holes 561*a* are disposed at intervals from each other in the opening and closing direction. Specifically, the plurality of holes 561*a* are disposed at positions corresponding to the respective holes 212*a* of the flange part 212. Each of the plurality of holes 561*a* is a long hole extending in the entrance direction. A distance between centers of each two holes 561*a* adjacent to each other in the opening and closing direction is equal to a distance between centers of each two holes 212*a* adjacent to each other in the opening and closing direction of the flange part 212.

The first portion 561 is connected to the first connecting parts 551 of the extension members 55 by the connecting members (first connecting members) 57 (bolts 571 and nuts 572) inserted through the respective holes 551*a* of the first connecting parts 551, the respective holes 212*a* of the flange part 212, and the respective holes 561*a* of the first portion 561, which overlap each other as viewed from the vertical direction, with the flange part 212 sandwiched between the first portion 561 and the first connecting parts 551.

The second portion 562 has a plurality of holes 562*a* corresponding in number to the number of holes 211*a* of the frame body 211 of the frame 21. The plurality of holes 562*a* are disposed at intervals from each other in the opening and closing direction. Specifically, the plurality of holes 562*a* are disposed at positions corresponding to the respective holes 211*a* of the frame body 211. Each of the plurality of holes 562*a* is a long hole extending in the vertical direction. A distance between centers of each two holes 562*a* adjacent to each other in the opening and closing direction is equal to a distance between centers of each two holes 211*a* adjacent to each other in the opening and closing direction of the frame body 211.

The second portion 562 is connected to the frame body 211 by the connecting members (second connecting members) 57 (bolts 571 and nuts 572) inserted through the respective holes 211*a* of the frame body 211 and the respective holes 562*a* of the second portion 562, which overlap each other as viewed from the entrance direction with the second portion 562 overlapping the frame body 211.

The plurality of ribs 565 are portions connecting to each other the first portion 561 and the second portion 562, which have a plate shape extending in directions crossing each other, to maintain the angle of the second portion 562 to the first portion 561. Each of the plurality of ribs 565 has a plate shape extending in the vertical direction and the entrance direction.

According to the height raising member 5, and the car door device 1 equipped with the height raising member 5 as described above, the supporting part 521 of the height raising member 5 supports the motor 4 with the first connecting part 551 of the height raising member 5 mounted to the upper end of the frame 21 (flange part 212), so that the motor 4 is disposed at a high position relative to the frame 21 over a distance corresponding to the distance between the first connecting part 551 and the supporting part 521 (that is, the total dimension in the vertical direction of the height raising member body 50 and each of the extension members 55). This configuration enables the frame 21 to be disposed at a low position in the car 7 even when the motor 4 is disposed above a top board of the car 7, consequently suppressing the height dimension of the car doors 3. That is, this configuration can increase a distance a from the upper end of the entrance 71 of the car 7 (see FIG. 1).

Moreover, since the motor 4 is connected to the frame 21 via the height raising member 5, the distance between the pulley 43 of the motor 4 and the pulley 23*a* mounted to the frame 21 remains the same even in the case where a change in the relative position between the car 7 and the frame 21 resulting from vibration, temperature change, or the like occurs. This configuration can prevent the belt 45 connecting the motor 4 and the pulley 23*a* to each other from, for example, being loosened.

The frame 21 disposed at a low position can suppress the height of the car doors 3, thereby enabling the car doors 3 to have a low center of gravity. Consequently, the car doors 3 can be made to stably open and close at a high speed in the driving system configured to cause the endless belt 24 to drive the upper portions of the car doors 3 to open and close the car doors 3, as in the car door device 1 of this embodiment.

In the height raising member 5 of this embodiment, the height raising member body 50 includes the distance adjusting part 59 capable of adjusting the distance between the pulley 23*a* and the motor 4 (specifically, the pulley 43 of the motor 4). This configuration enables the distance between the pulley 23*a* and the motor 4 to be adjusted even in the state where the height raising member 5 mounted to the frame 21 supports the motor 4, and can thus retighten the loosened second endless belt 45 that transmits the rotative power of the motor 4 to the pulley 23*a*, or finely adjust the height position of the motor 4 relative to the frame 21.

In the height raising member 5 of this embodiment, the distance adjusting part 59 includes: the at least one first long hole 512*a* extending in the vertical direction in the upwardly extending part 512 of the first member 51; the at least one second long hole 522*a* extending in the vertical direction in the downwardly extending part 522 of the second member 52 at a position at which the at least one second long hole 522*a* at least partially overlaps the at least one first long hole 512*a*; and the at least one fixing member 53 inserted through the first long hole 512*a* and the second long hole 522*a* overlapping each other to bring the downwardly extending part 522 into engagement with the upwardly extending part 512 in a relatively movable manner in the vertical direction, and to enable the downwardly extending part 522 to be fixed to the upwardly extending part 512 at a given relative position within a range based on the first long hole 512*a* and the second long hole 522*a* overlapping each other. This configuration enables relative movement between the first member 51 and the second member 52 in a mutually engaged state, that is, enables adjustment of the distance between the frame 21 (pulley 23*a*) and the motor 4. Thus, the motor 4 or the second member 52 can be prevented from, for example, falling when, for example, the distance between the frame 21 (pulley 23*a*) and the motor 4 is adjusted.

In the height raising member 5 of this embodiment, a plurality of groups each of which includes the two fixing members 53, and the first long hole 512*a* and the second long hole 522*a* through which the two fixing members 53 are inserted are disposed at intervals from each other in the horizontal direction. This configuration enables vertical movement (relative movement) of the second member 52 (that is, the motor 4 supported by the second member 52) while the second member 52 maintains its posture relative to the first member 51 (that is, the frame 21 to which the first member 51 is connected).

In the height raising member 5 of this embodiment, the upwardly extending part 512 and the downwardly extending part 522 have a flat plate shape and overlap in parallel with each other, and the extending part 552 of the extension member 55 has a flat plate shape extending in a direction crossing the upwardly extending part 512 and the downwardly extending part 522 as viewed from the vertical direction. Since the extension member 55 (i.e., the plate-shaped extending part) extends in a direction crossing the direction in which the height raising member body 50 (i.e., the plate-shaped upwardly extending part 512 and downwardly extending part 522) extends, as described above, the height raising member 5 in which the extension member 55 is connected to the height raising member body 50 can secure its sufficient strength.

In the car door device 1 of this embodiment, the first portion 561 of the bracket 56 disposed on the inner side of the frame 21 and the first connecting part 551 of the height raising member 5 are connected to each other by the connecting members (first connecting members) 57 with the flange part 212 sandwiched between the first portion 561 and the first connecting part 551, and the second portion 562 of the bracket 56 and the frame body 211 are connected to each other by the connecting members (second connecting members) 57 with the second portion 562 and the frame body 211 overlapping each other. As described above, even when the frame 21 has a thin plate shape, the bracket 56 disposed along a bent portion on the upper end portion (flange part 212) of the frame 21 can secure the strength of the frame 21, to thereby enable the dimension of the car door device 1 (i.e., the frame 21 and portions close thereto) in the entrance direction of the car door 7 (front-back direction) to be suppressed.

Next, a description will be given on a second embodiment of the present invention with reference to FIG. 6 to FIG. 10.

Figure 6:
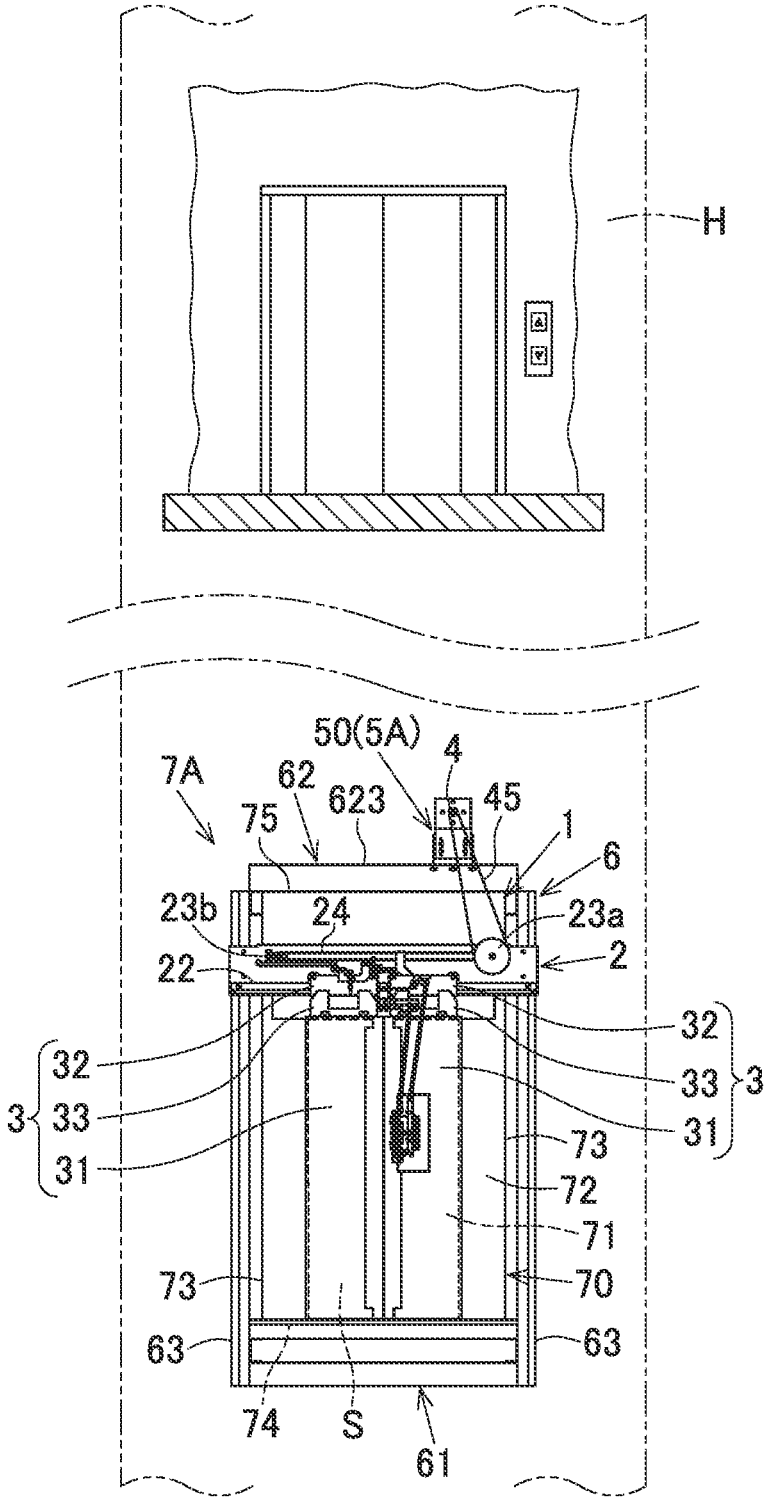
FIG. 6 is a schematic view of an elevator according to a second embodiment of the present invention.

A car 7A of an elevator according to this embodiment moves up and down through an elevator shaft H to transport users or the like to a destination floor. Specifically, as shown in FIG. 6, the car 7A includes: a cage 70 including an entrance 71; a car door device 1 that opens and closes the entrance 71 of the cage 70; a car frame 6 supporting the cage 70; and a height raising member 5A mounted to the car frame 6.

The cage 70 has a cage space S in which users or the like can be accommodated, and the users or the like get on or off the cage 70 through the entrance 71. The cage 70 of this embodiment has a cuboid shape, and includes: a front wall 72 on which the entrance 71 having a rectangular shape is formed or open; a rear wall opposed to the front wall 72 with a distance therebetween; and a pair of side walls 73 each connecting an end of the front wall 72 and an end of the rear wall. The cage 70 further includes a bottom wall 74 and a ceiling wall 75 both extending in a horizontal direction.

The car door device 1 includes: a frame part 2 disposed above the entrance 71 of the cage 70; at least one car door 3 that opens and closes the entrance 71 of the cage 70; and a motor 4 for opening and closing the at least one car door 3. The car door device 1 of this embodiment is a so-called center-open type car door device having two car doors 3.

Figure 7:
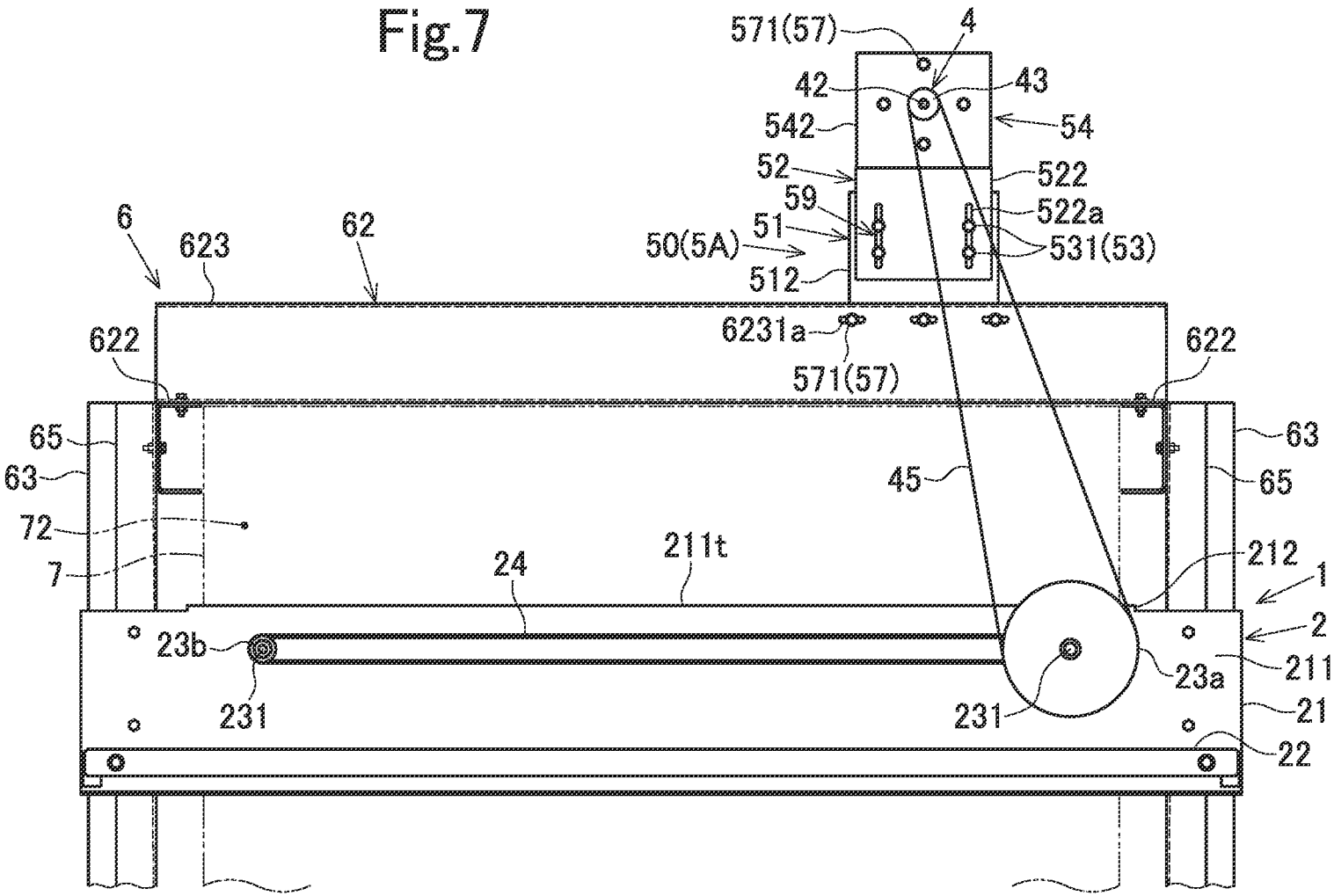
FIG. 7 is a front view of an upper part of a car of the elevator, with some configurations thereof omitted.
Figure 8:
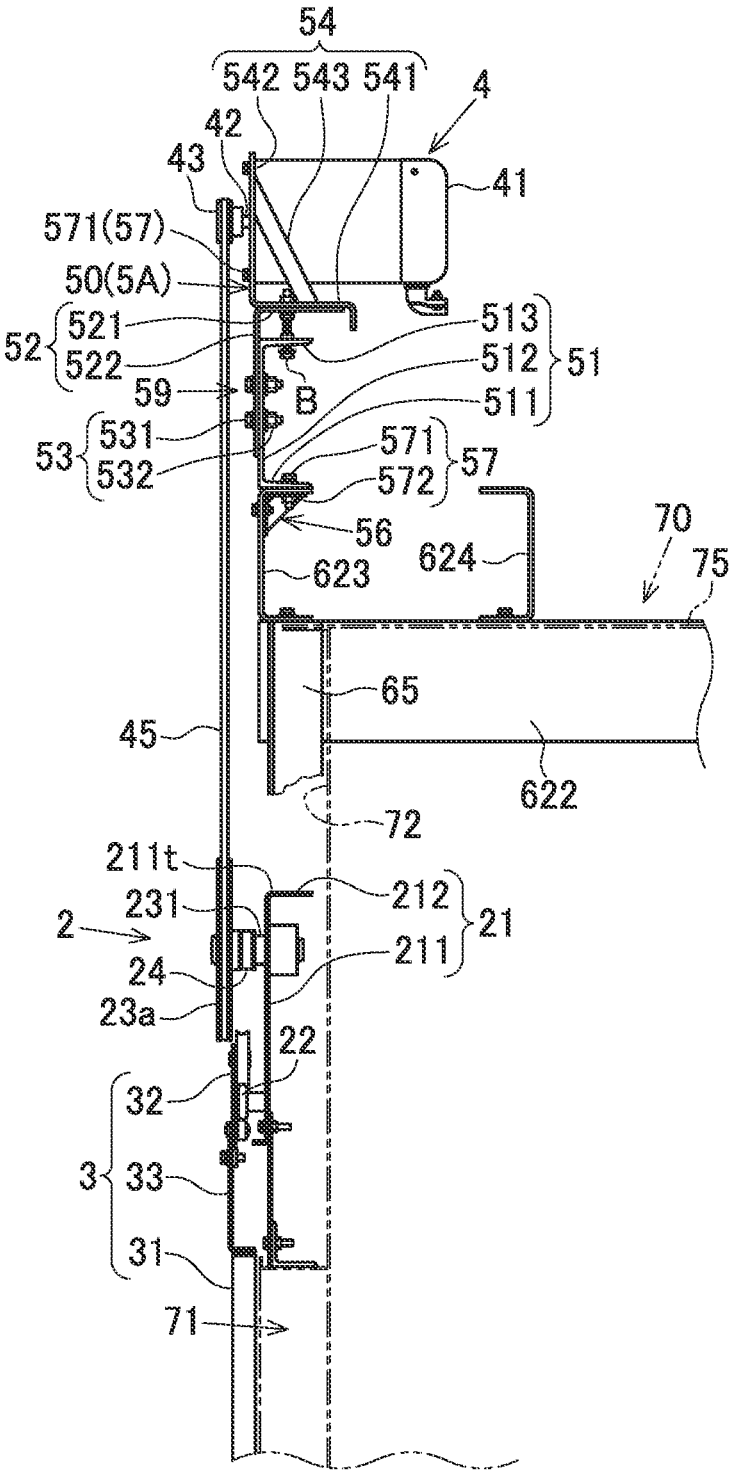
FIG. 8 is a side view of a front side portion of the upper part of the car, with some configurations thereof omitted.

As shown in FIG. 7 and FIG. 8, the frame part 2 includes: a frame 21 disposed at a position above the entrance 71 on an outer surface of the front wall 72 of the cage 70; a rail 22 for guiding the car doors 3 in their opening and closing direction (hereinafter referred also to simply as "opening and closing direction"); a pair of pulleys 23*a* and 23*b* disposed on the frame 21 with a distance therebetween in the opening and closing direction; and a first endless belt 24 wound around the pair of pulleys 23*a* and 23*b*.

The frame 21 includes: a frame body 211 having a plate shape extending in a vertical direction and the opening and closing direction, and having an upper end 211*t* linearly extending along the opening and closing direction; and a flange part 212 extending from the upper end 211*t* of the frame body 211 to a rear side in an entrance direction of the cage 70 (hereinafter referred also to simply as "entrance direction"). In the frame 21 of this embodiment, the frame body 211 and the flange part 212 are formed by bending an end portion of one metal plate.

The frame body 211 is a plate-shaped portion having the upper end 211*t* linearly extending along the opening and closing direction. The frame body 211 of this embodiment has a rectangular plate shape elongated in the opening and closing direction. At least the rail 22 and the pair of pulleys 23*a* and 23*b* are mounted to the frame body 211.

The rail 22 is disposed on the frame body 211 of the frame 21 (specifically, on a lower end portion of the frame body 211). The rail 22 extends in the opening and closing direction at a position above the entrance 71 of the cage 70. The rail 22 of this embodiment guides each of the two car doors 3.

The pair of pulleys 23*a* and 23*b* are disposed with a distance therebetween in the opening and closing direction at a position above the rail 22 in the frame body 211. More specifically, in the frame body 211, the pulleys 23*a* and 23*b* respectively have rotary shafts 231 extending in the entrance direction at the same height as each other and located outside in the opening and closing direction of the entrance 71. The pulleys 23*a* and 23*b* are mounted to the frame body 211 in a manner rotatable about the respective rotary shafts 231. One pulley 23*a* out of the pair of pulleys 23*a* and 23*b* of this embodiment is a so-called two stage pulley having two winding portions around which the endless belts 24 and 25 can be wound, and these two winding portions have different diameters from each other. The one pulley 23*a* is disposed outside in the opening and closing direction of the height raising member 5A. The other pulley 23*b* has a winding portion having a diameter that is the same as the diameter of the smaller diameter winding portion of the one pulley 23*a*.

Each of the two car doors 3 includes: a door panel 31 having a rectangular plate shape; a door hanger 32 guided by the rail 22 while allowing the door panel 31 to hang down therefrom; and an intermediate member 33 connecting the door hanger 32 and the door panel 31 to each other. The door panel 31 of this embodiment has a rectangular shape elongated in the vertical direction. The door hangers 32 are connected to the first endless belt 24. Specifically, the door hanger 32 of one of the two car doors 3 is connected to an upper one of two upper and lower belt segments (i.e., a segment of the first endless belt 24) spanning between the pair of pulleys 23*a* and 23*b*, while the door hanger 32 of the other one of the two car doors 3 is connected to the lower segment of the belt 24. This configuration allows the two car doors 3 to operate simultaneously with each other for opening and closing. That is, when one of the two car doors 3 moves for opening and closing operation, the other one of the two car doors 3 also moves for opening and closing operation in association with (synchronously with) the opening and closing operation of the one of the two car doors 3.

The motor 4 includes: a motor body 41; an output shaft 42 projecting from the motor body 41 and outputting rotative power; and a pulley 43 mounted to the output shaft 42. The motor 4 is disposed to have the output shaft 42 directed to a front side in the entrance direction and extending in a direction corresponding to the entrance direction of the cage 70 (i.e., front-back direction). A second endless belt (belt) 45 is wound around the pulley 43 of the motor 4 and the pulley 23*a* disposed on the frame 21. This configuration allows the rotative power output from the output shaft 42 of the motor 4 to be transmitted to the pulley 23*a* of the frame 21 via the second endless belt 45.

In the car door device 1 of this embodiment, the pair of pulleys 23*a* and 23*b*, the first endless belt 24, the motor 4, and the second endless belt 45 form the drive mechanism of the car doors 3.

Figure 9:
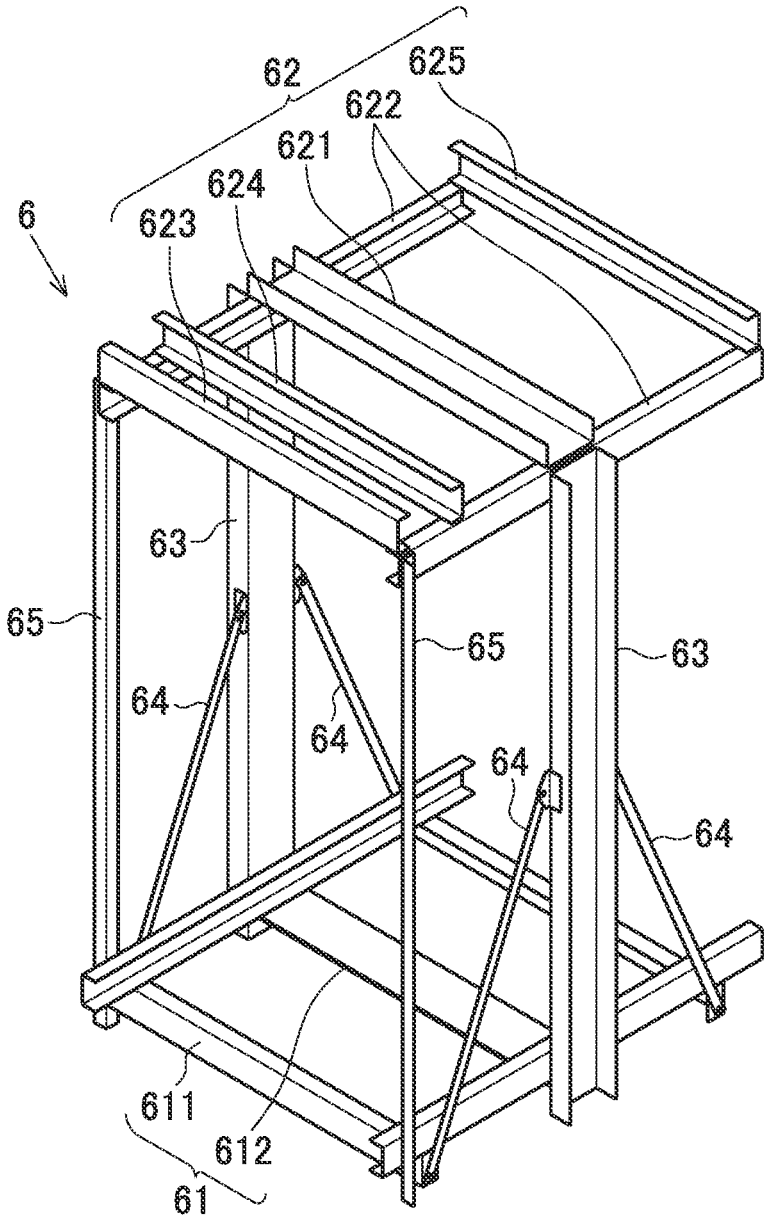
FIG. 9 is a perspective view of a car frame of the car.
Figure 10:
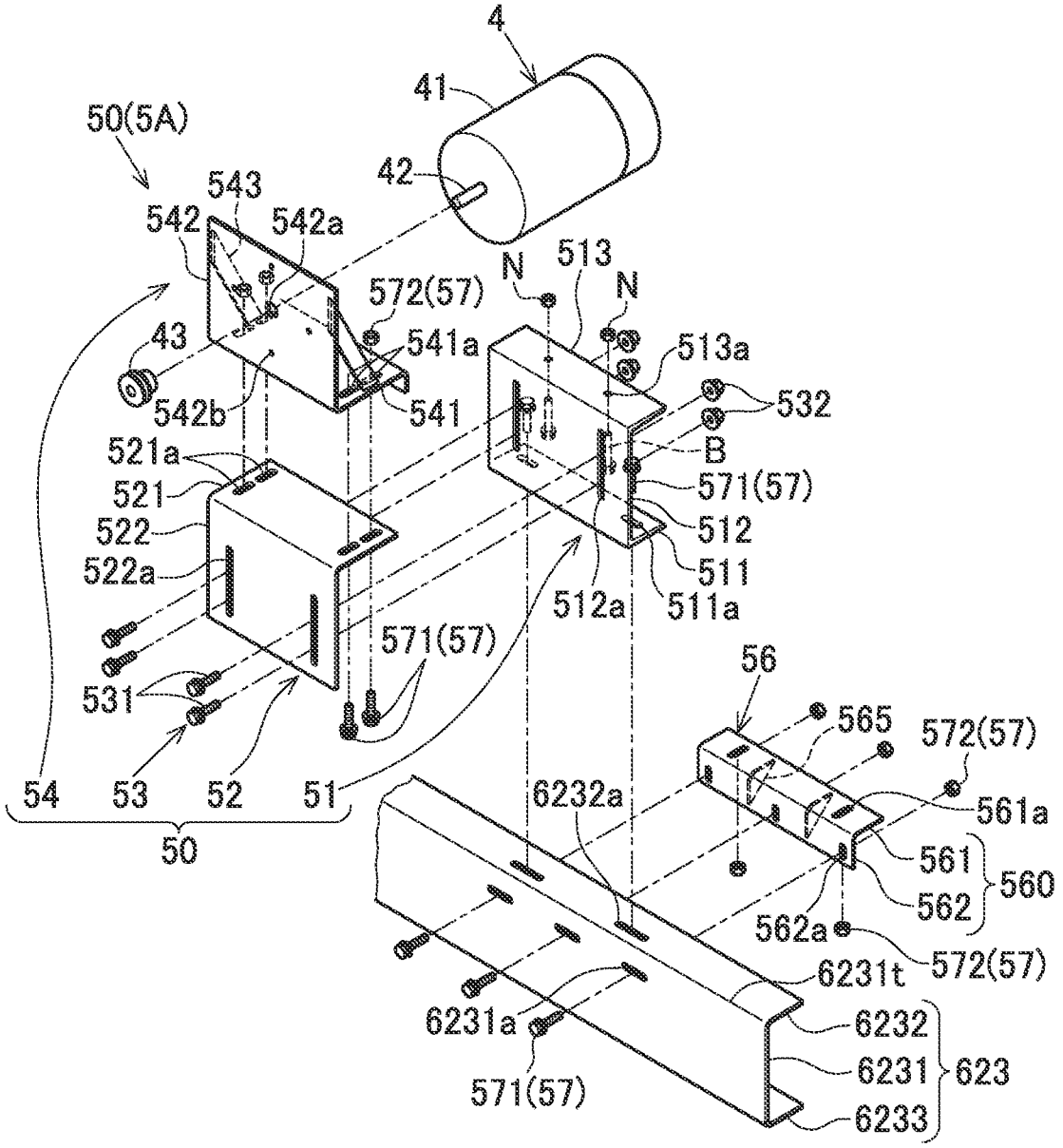
FIG. 10 is an exploded perspective view of a height raising member for raising a mounting position of a motor for an elevator door of the car, and members therearound.
Figure 11:
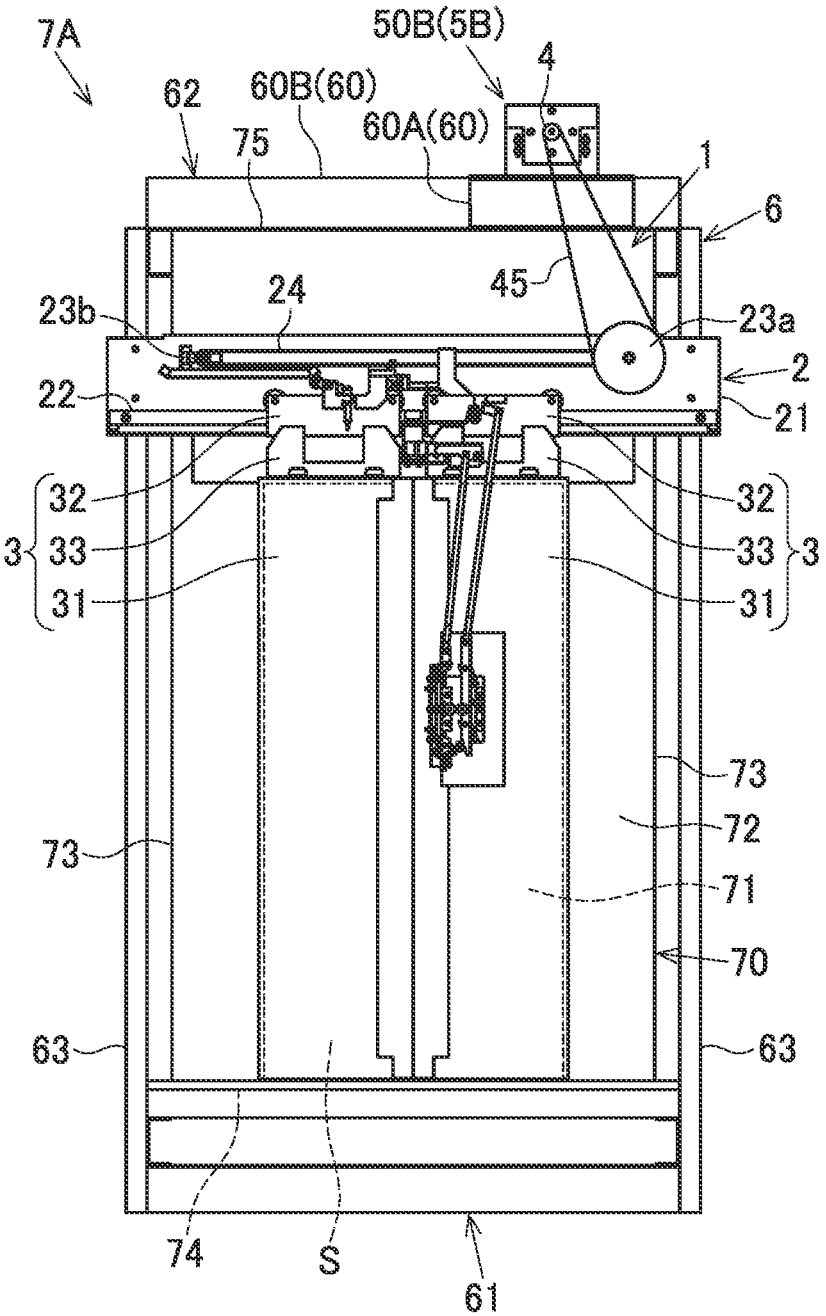
FIG. 11 is a front view of a car of an elevator according to a third embodiment of the present invention.
Figure 12:
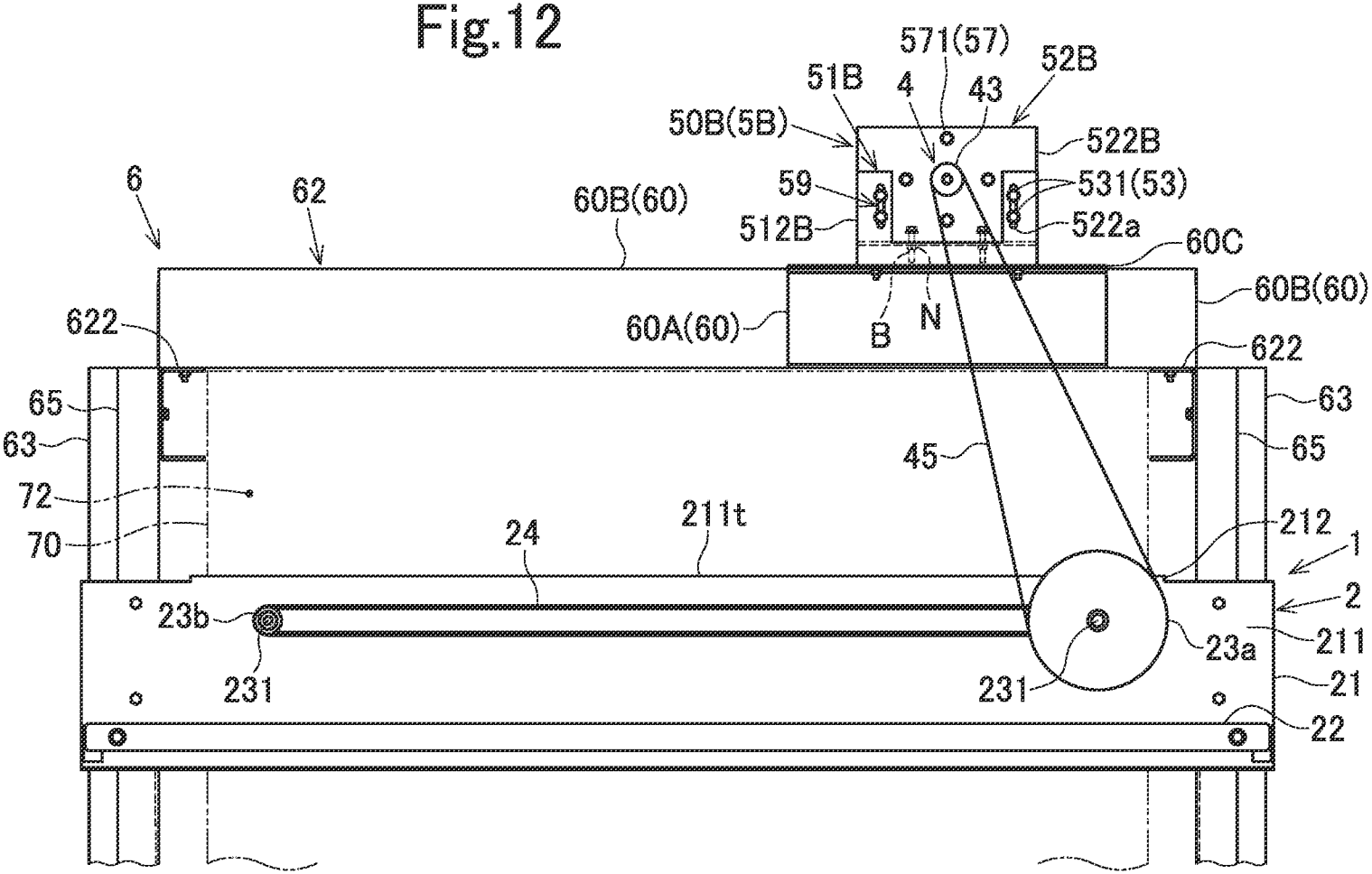
FIG. 12 is a front view of an upper part of the car, with some configurations thereof omitted.
Figure 13:
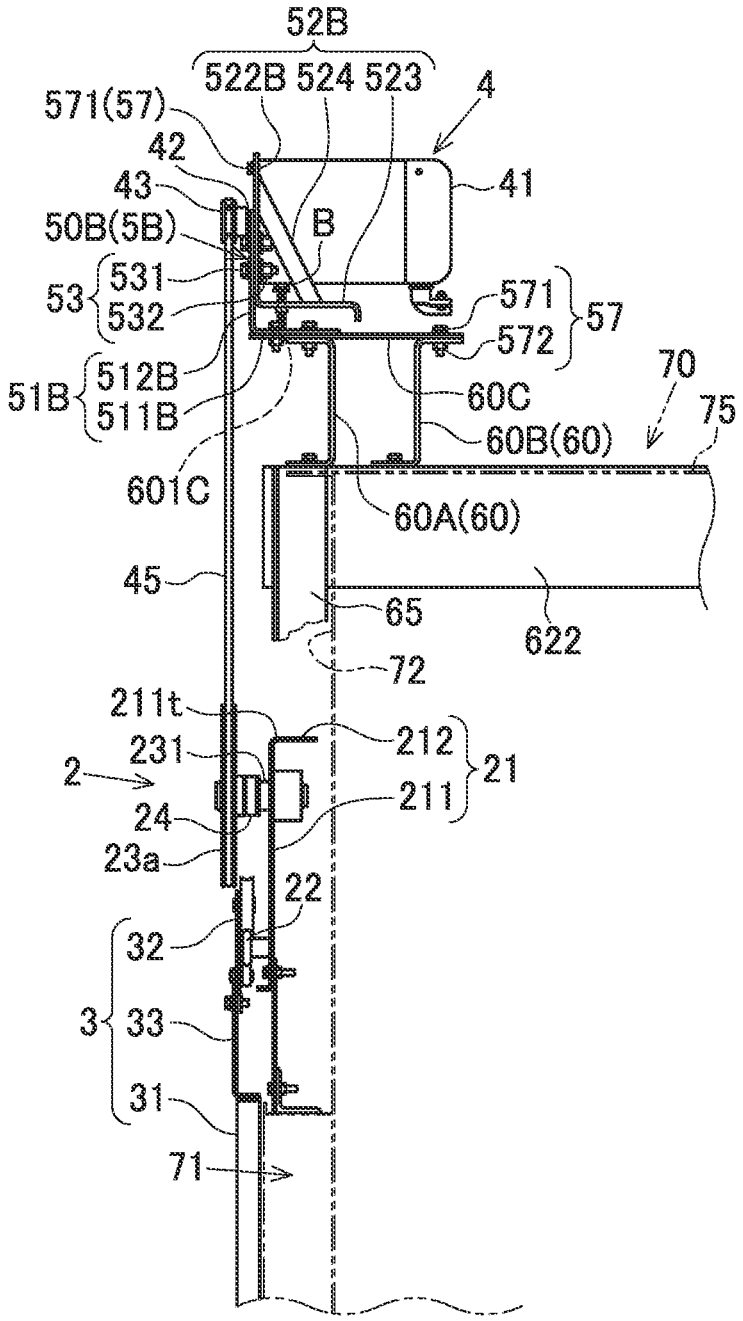
FIG. 13 is a side view of a front side portion of the upper part of the car, with some configurations thereof omitted.

The car frame 6 is a member that moves up and down while supporting the cage 70. Specifically, the car frame 6 encloses the cage 70 to thereby support the cage 70, and has a main rope of the elevator connected thereto. As shown in FIG. 9 and FIG. 10, the car frame 6 includes a first beam (base member) 623 extending in the opening and closing direction above the frame 21. More specifically, the car frame 6 includes: a lower frame 61 disposed under the bottom of the cage 70; an upper frame 62 disposed on the top of the cage 70; and a pair of vertical frames 63 connecting the lower frame 61 and the upper frame 62 to each other. Further, the car frame 6 includes: a plurality of braces 64 for reinforcing the vertical frames 63; and a pair of front angles 65 each connecting a front side end of the lower frame 61 and a front side end of the upper frame 62 to each other.

The lower frame 61 includes: a rectangular frame part 611 having a rectangular shape as viewed from the vertical direction; and a plank 612 extending in the opening and closing direction at a center portion in the entrance direction (front-back direction) of the rectangular frame part 611.

The upper frame 62 includes: a crosshead 621 extending in the opening and closing direction at a position opposed to the plank 612; and a pair of support channels 622 extending in the entrance direction from the respective ends of the crosshead 621. Further, the upper frame 62 includes: the first beam 623 extending in the opening and closing direction and connecting one ends (i.e., on the front side of the cage 70) respectively of the pair of support channels 622 to each other; a second beam 624 extending in the opening and closing direction and connecting the pair of support channels 622 between the first beam 623 and the crosshead 621; and a third beam 625 extending in the opening and closing direction and connecting the other ends respectively of the pair of support channels 622 to each other.

The first beam 623 includes: a beam body (body) 6231 having a strip plate shape that extends in the opening and closing direction and has a thickness direction corresponding to the entrance direction; and an upper flange part (flange part) 6232 extending from an upper end 6231*t* of the beam body 6231 to the rear side in the entrance direction. The first beam 623 of this embodiment further includes a lower flange part 6233 extending from a lower end of the beam body 6231 to the rear side in the entrance direction.

The beam body 6231 has a strip plate shape having the upper end 6231*t* linearly extending along the opening and closing direction. The beam body 6231 has a plurality of holes 6231*a* aligned at intervals from each other in the opening and closing direction. Each of the plurality of holes 6231*a* is a long hole extending in the opening and closing direction. The plurality of holes 6231*a* are disposed at a position on one end side in the opening and closing direction with respect to the center of the beam body 6231. The plurality of holes 6231*a* are aligned at equal intervals in the opening and closing direction.

The upper flange part 6232 is a plate-shaped portion extending in the opening and closing direction and to the rear side in the entrance direction from the upper end 6231*t* of the beam body 6231. The upper flange part 6232 has a strip plate shape that has a constant or a substantially constant dimension in the entrance direction (i.e., width) at any position in the opening and closing direction of the upper flange part 6232 and that is elongated in the opening and closing direction.

The upper flange part 6232 has a plurality of holes 6232*a* aligned at intervals from each other in the opening and closing direction. Each of the plurality of holes 6232*a* is a long hole extending in the opening and closing direction. The upper flange part 6232 of this embodiment has two holes 6232*a*, which are disposed in an area (position) corresponding in the opening and closing direction to the area of the beam body 6231 in which the plurality of holes 6231*a* are disposed. That is, the two holes 6232*a* are disposed at a position on one end side in the opening and closing direction with respect to the center of the beam body 6231.

Each of the pair of vertical frames 63 extends in the vertical direction, and connects an end of the plank 612 and a corresponding end of the crosshead 621 to each other.

Each of the plurality of braces 64 extends in a direction inclined to the vertical direction, and connects an intermediate portion in the vertical direction of one of the vertical frames 63 and an end in the entrance direction of the rectangular frame part 611 to secure the strength of the car frame 6. Two braces 64 are disposed for each of the pair of vertical frames 63.

Each of the pair of front angles 65 extends in the vertical direction, and connects a front side end of the support channel 622 and a front side end (corner) of the rectangular frame part 611 to each other.

The height raising member 5A supports the motor 4 while being mounted to the first beam 623. The height raising member 5A includes a height raising member body 50 mountable to an upper end of the first beam 623. Specifically, the height raising member body 50 includes: a base part 511 connectable to the first beam 623; and a supporting part 521 capable of supporting the motor 4 at a position upward away from the base part 511, the motor 4 being configured to drive the pulley 23*a* via the second endless belt (belt) 45.

The height raising member body 50 includes a distance adjusting part 59 capable of adjusting a distance between the pulley 23*a* and the motor 4, specifically, a distance between the pulley 23*a* mounted to the frame 21 and the pulley 43 of the motor 4 (see FIG. 7). Specifically, the height raising member body 50 includes: a first member 51 connectable to the first beam 623; a second member 52 capable of moving relative to the first member 51; and a fixing member 53 fixing the second member 52 to the first member 51. The height raising member body 50 of this embodiment includes a motor connecting member 54 that connects the motor 4 and the second member 52 to each other. The height raising member 5A of this embodiment includes a bracket 56 that fixes the height raising member body 50 to the first beam 623 and that can secure the strength of the first beam 623. The height raising member 5A further includes a plurality of connecting members 57 for connecting members to each other. The plurality of connecting members 57 of this embodiment include bolts 571, or include bolts 571 and nuts 572 screwed with the bolts 571. The height raising member body 50 of this embodiment includes at least one push up member B capable of pushing the second member 52 upward relative to the first member 51.

The first member 51 includes: the base part 511 connectable to the first beam 623; and an upwardly extending part 512 extending upward from the base part 511. The first member 51 further includes a flange part 513 extending from a leading end of the upwardly extending part 512 toward the rear side of the car 7.

The base part 511 is a plate-shaped portion extending in the opening and closing direction and the entrance direction, and has a plurality of holes 511*a* penetrating therethrough in the vertical direction. The plurality of holes 511*a* are disposed at intervals from each other in the opening and closing direction, and each of the plurality of holes 511*a* is a long hole extending in the opening and closing direction. The base part 511 of this embodiment has a rectangular plate shape elongated in the opening and closing direction, and has two holes 511*a*.

The upwardly extending part 512 is a plate-shaped (flat plate-shaped) portion extending upward from the base part 511. Specifically, the upwardly extending part 512 has a rectangular plate shape extending in the opening and closing direction and the vertical direction, and has at least one first long hole 512*a* penetrating therethrough in its thickness direction and extending in the vertical direction. This upwardly extending part 512 extends upward from a front side end in the entrance direction of the base part 511. The upwardly extending part 512 of this embodiment has a plurality of first long holes 512*a*, which are disposed at intervals from each other in the opening and closing direction. More specifically, the upwardly extending portion 512 has two first long holes 512*a*.

The flange part 513 is a plate-shaped portion extending in the opening and closing direction and the entrance direction, and has a plurality of holes 513*a* penetrating therethrough in the vertical direction. The plurality of holes 513*a* are disposed at intervals from each other in the opening and closing direction. The flange part 513 of this embodiment has a rectangular plate shape elongated in the opening and closing direction, and has two holes 513*a*. The flange part 513 extends from the upper end of the upwardly extending part 512 to the rear side in the entrance direction. Each of the two holes 513*a* is a screw hole (tapped hole) having internal threads formed on its inner circumferential surface.

The second member 52 includes: the supporting part 521 supporting the motor 4; and a downwardly extending part 522 extending downward from the supporting part 521, and is fixed to the first member 51 with the downwardly extending part 522 overlapping the upwardly extending part 512 as viewed from the horizontal direction.

The supporting part 521 has a plate shape extending in the opening and closing direction and the entrance direction, and has a plurality of holes 521*a* penetrating therethrough in the vertical direction. In the supporting part 521, a plurality of (two in the example of this embodiment) holes 521*a* aligned in the entrance direction form one row, a plurality of which (two rows in the example of this embodiment) are disposed at intervals from each other in the opening and closing direction. The plurality of holes 521*a* forming each of the plurality of rows are long holes extending in the entrance direction. Each of the plurality of holes 521*a* is disposed at a position not overlapping each of the holes 513*a* of the flange part 513 of the first member 51 as viewed from the vertical direction.

The downwardly extending part 522 is a plate-shaped (flat plate-shaped) portion extending downward from the supporting part 521, and overlaps the upwardly extending part 512 of the first member 51 in parallel with each other. Specifically, the downwardly extending part 522 has a rectangular plate shape extending in the opening and closing direction and the vertical direction, and has at least one second long hole 522*a* penetrating therethrough in its thickness direction. The at least one second long hole 522*a* extends in the vertical direction at a position at which it at least partially overlaps one of the first long holes 512*a* of the upwardly extending part 512. More specifically, the at least one second long hole 522*a* is disposed at a position that is the same as the position in the opening and closing direction of a corresponding one of the first long holes 512*a* (through which the common fixing member 53 is inserted) and at a position at which it at least partially overlaps the first long hole 512*a* in the vertical direction. The downwardly extending part 522 of this embodiment has the second long hole 522*a* at a position corresponding to one of the plurality of first long holes 512*a*. That is, in the downwardly extending part 522, a plurality of second long holes 522*a* are disposed at intervals from each other in the opening and closing direction. More specifically, the downwardly extending part 522 has two second long holes 522*a*.

The fixing member 53 can be inserted through one of the first long holes 512*a* and the second long hole 522*a* corresponding to (overlapping) the first long hole 512*a* to thereby bring the downwardly extending part 522 into engagement with the upwardly extending part 512 in a relatively movable manner in the vertical direction, and to enable the downwardly extending part 522 to be fixed to the upwardly extending part 512 at a given relative position within a range based on the first long hole 512*a* and the second long hole 522*a* through which the at least one fixing member 53 is inserted. In the height raising member 5A of this embodiment, a plurality of (two in the example shown in FIG. 10) fixing members 53 are inserted through one of the first long holes 512 and the corresponding one of the second long holes 522*a* that are at least partially overlapping each other.

Specifically, each of the plurality of fixing members 53 includes: a bolt 531 inserted through the first long hole 512*a* and second long hole 522*a* overlapping each other; and a nut 532 screwed with the bolt 531. The bolt 531 inserted through the first long hole 512*a* and the second long hole 522*a* overlapping each other as viewed from the entrance direction brings the upwardly extending part 512 and the downwardly extending part 522 into engagement with each other so as to allow the downwardly extending part 522 to be relatively movable in the vertical direction (i.e., the direction in which the first long hole 512*a* or the second long hole 522*a* extends) relative to the upwardly extending part 512. At this time, the range within (i.e., the distance over) which the downwardly extending part 522 is relatively movable in the vertical direction relative to the upwardly extending part 512 is defined by the dimensions in the vertical direction of the first long hole 512*a* and the second long hole 522*a* overlapping each other. When the downwardly extending part 522 reaches a certain position relative to the upwardly extending part 512, the nut 532 screwed with the bolt 531 is fastened to thereby allow the downwardly extending part 522 to be fixed to the upwardly extending part 512 at the certain position. The two nuts 532 disposed vertically can be substituted by a plate nut having two screw holes (tapped holes).

In the height raising member body 50 (height raising member 5A) of this embodiment, the distance adjusting part 59 is formed by the first long holes 512*a* and the second long holes 522*a* overlapping each other, and the fixing members 53 inserted through the first long holes 512*a* and the second long holes 522*a* overlapping each other (see FIG. 7). In the height raising member body 50 of this embodiment, two fixing members 53 (specifically, two bolts 531) are inserted through the first long hole 512*a* and the second long hole 522*a* overlapping each other. A plurality of groups each of which includes these two fixing members 53, and the first long hole 512*a* and the second long hole 522*a* through which the two fixing members 53 are inserted are disposed at intervals from each other in the horizontal direction. More specifically, two groups are disposed with a distance therebetween in the opening and closing direction.

The motor connecting member 54 includes: a supporting part connecting part 541 having a plate shape extending in the opening and closing direction and the entrance direction; and a motor connecting part 542 extending upward from the supporting part connecting part 541 and to which an end of the motor 4 on a side of the output shaft 42 is connectable. The motor connecting member 54 includes at least one reinforcing part 543 connecting the supporting part connecting part 541 and the motor connecting part 542 to each other.

The supporting part connecting part 541 has a rectangular plate shape, with a rear side end portion in the entrance direction being bent downward. The supporting part connecting part 541 has holes 541*a* at positions corresponding to the respective holes 521*a* of the supporting part 521 of the second member 52. That is, a plurality of (two in the example of this embodiment) holes 541*a* aligned in the entrance direction form row, a plurality of which (two rows in the example of this embodiment) are disposed at intervals from each other in the opening and closing direction. The plurality of holes 541*a* forming each of the plurality of rows are long holes extending in the entrance direction. The supporting part connecting part 541 is connected (fixed) to the supporting part 521 while overlapping the supporting part 521 of the second member 52, by the connecting members 57 (i.e., the bolts 571 and the nuts 572) inserted through the respective holes 541*a* and the corresponding ones of the holes 521*a* of the supporting part 521.

The motor connecting part 542 extends upward from a front side end in the entrance direction of the supporting part connecting part 541. Specifically, the motor connecting part 542 has a plate shape extending in the vertical direction and the opening and closing direction, and has a hole 542*a* penetrating therethrough in the entrance direction. The output shaft 42 of the motor 4 is inserted through the hole 542*a*. The motor connecting part 542 has a rectangular plate shape, and has the hole 542*a* at a central portion. The motor connecting part 542 further has a plurality of holes 542*b* around the hole 542*a*. The hole 542*a* at the central portion has a larger diameter than the diameter of each of the plurality of holes 542*b* disposed around the hole 542*a*.

The at least one reinforcing part 543 connects a rear portion of the supporting part connecting part 541 and an upper portion of the motor connecting part 542 to each other at an end in the opening and closing direction of the motor connecting member 54. The at least one reinforcing part 543 of this embodiment has a strip plate shape extending in a direction inclined to both the supporting part connecting part 541 and the motor connecting part 542.

In the motor connecting member 54, the fore part of the motor 4 (i.e., the part of the motor 4 through which the output shaft 42 projects) is connected to the motor connecting part 542 by the connecting members 57 (the bolts 571: see FIG. 8) inserted through the respective holes 542*b* of the motor connecting part 542, in the state where the output shaft 42 projects to the front side in the entrance direction through the hole 542*a* of the motor connecting part 542. In this state, a rear end in the entrance direction of the supporting part 521 of the second member 52 is located more on the front side than the central position of the motor body 41. That is, the motor 4 is connected (disposed) to the height raising member body 50 by the motor connecting member 54 so as to allow the rear portion of the motor 4 to greatly project in the entrance direction from the height raising member 5A. In FIG. 10, the illustration of the connecting members 57 (bolts 571) for connecting the motor 4 to the motor connecting part 542 is omitted for the sake of facilitating the viewing of the figure.

The at least one push up member B is a jack-up bolt inserted upward through the hole 513*a* of the flange part 513 of the first member 51. After the fixing members 53 are loosened to unfix the second member 52 from the first member 51, the at least one push up member B having the shaft with external threads formed on its circumferential surface is caused to rotate about the shaft while the leading end of the shaft is held in contact with the supporting part 521 of the second member 52, so that the position in the vertical direction of the second member 52 relative to the first member 51 (i.e., the distance in the vertical direction between the flange part 513 and the supporting part 521) can be adjusted. The height raising member body 50 of this embodiment includes a plurality of push up members B.

Specifically, in order to raise the position of the motor 4, the respective push up members B are caused to rotate about their shafts for ascending while the second member 52 is unfixed from the first member 51, so that the leading ends of the respective push up members B held in contact with the supporting part 521 (second member 52) push up the supporting part 521. The motor 4 thereby ascends.

In order to allow the motor 4 to descend, on the other hand, the respective push up members B are caused to rotate about their shafts (in the inverse rotation direction of the direction when the motor 4 ascends) for descending while the second member 52 is unfixed from the first member 51, so that the motor 4, the motor connecting member 54, and the second member 52 descend by their own weight together with the push up members B while the supporting part 521 is supported by (i.e., held in contact with) the leading ends of the respective push up members B. The motor 4 thereby descends.

When the second member 52 thus reaches a desired height position (relative position) relative to the first member 51, the fixing members 53 (i.e., bolts 531 and nuts 532) are fastened to fix the second member 52 to the first member 51. Further, fastening members (nuts in the example of this embodiment) N screwed with the respective push up members B are fastened to also fix these push up members B. That is, the fastening members N play a role as double nuts.

The bracket 56 includes an angle part 560 extending in the opening and closing direction, and at least one rib 565 disposed to the angle part 560. The bracket 56 is disposed on the inner side of the first beam 623 (i.e., the side of the second beam 624) along the upper end of the first beam 623, specifically along the beam body 6231 and the upper flange part 6232 (see FIG. 8). The bracket 56 of this embodiment includes a plurality of ribs 565.

The angle part 560 is a portion having an L shape in cross section and including a first portion 561 extending along the upper flange part 6232 and a second portion 562 extending along the beam body 6231. Each of the first portion 561 and the second portion 562 of this embodiment has a rectangular plate shape elongated in the opening and closing direction.

The first portion 561 has a plurality of holes 561*a* corresponding in number to the number of holes 6232*a* of the upper flange part 6232 of the first beam 623. The plurality of holes 561*a* are disposed at intervals from each other in the opening and closing direction. Specifically, the plurality of holes 561*a* are disposed at positions corresponding to the respective holes 6232*a* of the upper flange part 6232. Each of the plurality of holes 561*a* is a long hole extending in the entrance direction. A distance between centers of each two holes 561*a* adjacent to each other in the opening and closing direction is equal to a distance between centers of each two holes 6232*a* adjacent to each other in the opening and closing direction of the upper flange part 6232.

The first portion 561 is connected to the base part 511 of the height raising member body 50 by the connecting members (first connecting members) 57 (bolts 571 and nuts 572 in the example of this embodiment) inserted through the respective holes 511*a* of the base part 511, the respective holes 6232*a* of the upper flange part 6232, and the respective holes 561*a* of the first portion 561, which overlap each other as viewed from the vertical direction, with the upper flange part 6232 sandwiched between the first portion 561 and the base part 511.

The second portion 562 has a plurality of holes 562*a* corresponding in number to the number of holes 6231*a* of the beam body 6231 of the first beam 623. The plurality of holes 562*a* are disposed at intervals from each other in the opening and closing direction. Specifically, the plurality of holes 562*a* are disposed at positions corresponding to the respective holes 6231*a* of the beam body 6231. Each of the plurality of holes 562*a* is a long hole extending in the vertical direction. A distance between centers of each two holes 562*a* adjacent to each other in the opening and closing direction is equal to a distance between centers of each two holes 6231*a* adjacent to each other in the opening and closing direction of the beam body 6231.

The second portion 562 is connected to the beam body 6231 by the connecting members (second connecting members) 57 (bolts 571 and nuts 572 in the example of this embodiment) inserted through the respective holes 6231*a* of the beam body 6231 and the respective holes 562*a* of the second portion 562, which overlap each other as viewed from the entrance direction with the second portion 562 overlapping the beam body 6231.

The plurality of ribs 565 are portions connecting to each other the first portion 561 and the second portion 562, which have a plate shape extending in directions crossing each other, to maintain the angle of the second portion 562 to the first portion 561. Each of the plurality of ribs 565 has a plate shape extending in the vertical direction and the entrance direction.

Even in the case where the motor 4 cannot be mounted to the frame 21 disposed close to the upper end of the entrance 71 of the cage 70 due to a large distance between the ceiling wall 75 of the cage 70 and the upper end of the entrance 71, the height raising member 5A of this embodiment and the car 7A equipped with the height raising member 5A enable the motor 4 to be disposed above the first beam 623 of the car frame 6. This configuration enables the frame 21 to be disposed at a low position in the cage 70 even when the motor 4 is disposed above the ceiling wall 75 of the cage 70. Consequently, the height dimension of the car doors 3 can be suppressed.

The frame 21 thus disposed at a low position in the cage 70 suppresses the height of the car doors 3, therefore enabling the car doors 3 to have a low center of gravity. Thus, as in the car door device 1 of the car 7A of this embodiment, the car doors 3 can be made to stably open and close at a high speed in the driving system configured to cause the first endless belt 24 to drive the upper portions of the car doors 3 to open and close the car doors 3.

In the height raising member 5A of this embodiment, the height raising member body 50 includes: the first member 51 including the base part 511 connectable to the first beam 623 and the upwardly extending part 512 extending upward from the base part 511; the second member 52 including the supporting part 521 capable of supporting the motor 4 at a position upward away from the base part 511 and the downwardly extending part 522 extending downward from the supporting part 521, the downwardly extending part 522 being fixed to the first member 51 while overlapping the upwardly extending part 512 as viewed from the horizontal direction; and the distance adjusting part 59 capable of adjusting the distance between the pulley 23*a* and the motor 4. The distance adjusting part 59 includes: the first long hole 512*a* penetrating through the upwardly extending part 512 and extending in the vertical direction; the second long hole 522*a* penetrating through the downwardly extending part 522 and extending in the vertical direction at a position at which the second long hole 522*a* at least partially overlaps the first long hole 512*a*; and the fixing members 53 inserted through the first long hole 512*a* and the second long hole 522*a* to bring the downwardly extending part 522 into engagement with the upwardly extending part 512 in a relatively movable manner in the vertical direction, and to enable the downwardly extending part 522 to be fixed to the upwardly extending part 512 at a given relative position within a range based on the first long hole 512*a* and the second long hole 522*a*.

The height raising member body 50 including the distance adjusting part 59 as described above enables the distance between the pulley 23*a* and the motor 4 to be adjusted even in the state where the height raising member 5A mounted to the first beam 623 supports the motor 4. This configuration can retighten the loosened second endless belt 45 that transmits the rotative power of the motor 4 to the pulley 23*a*, or finely adjust the height position of the motor 4 relative to the first beam 623. Moreover, this configuration enables relative movement between the first member 51 and the second member 52 in a mutually engaged state (that is, enables adjustment of the distance between the pulley 23*a* and the motor 4); thus, the motor 4 or the second member 52 can be prevented from, for example, falling when the distance between the pulley 23*a* and the motor 4 is adjusted.

In the height raising member 5A of this embodiment, the plurality of groups each of which is formed by the first long hole 512*a*, the second long hole 522*a*, and the fixing members 53 are disposed at intervals from each other in the horizontal direction. The configuration that the plurality of groups each of which includes the fixing members 53 inserted through the first long hole 512*a* and the second long hole 522*a* extending in the vertical direction are disposed at intervals from each other in the horizontal direction enables vertical movement (relative movement) of the second member 52 (that is, the motor 4 supported by the second member 52) while the second member 52 maintains its posture relative to the first member 51 (that is, the first beam 623 to which the first member 51 is connected).

In the height raising member 5A of this embodiment, the plurality of fixing members 53 are inserted through one of the first long holes 512 and the corresponding one of the second long holes 522*a* that are at least partially overlapping each other. The configuration that the plurality of fixing members 53 are inserted through a portion where the first long hole 512*a* and the second long hole 522*a* overlap each other enables vertical movement (relative movement) of the first member 52 (that is, the motor 4 supported by the second member 52) while the second member 52 maintains its posture relative to the first member 51 (that is, the first beam 623 to which the first member 51 is connected), and enables the downwardly extending part 522 (second member 52) to be firmly fixed to the upwardly extending part 512 (first member 51).

In the height raising member 5A of this embodiment, the height raising member body 50 includes the motor connecting part 54 including: the supporting part connecting part 541 connected to the supporting part 521; and the motor connecting part 542 extending upward from the supporting part connecting part 541 and to which the end of the motor 4 on the side of the output shaft 42 is connectable. Such a configuration enables the height raising member body 50 to support the motor 4 by the connection of the end of the motor 4 on the side of the output shaft 42 to the motor connecting part 542 in the state where the height raising member body 50 is fixed to the first beam 623.

In the car 7A of this embodiment, the first beam 623 includes: the beam body 6231 having a plate shape extending in the vertical direction and the opening and closing direction above the frame 21 and having the upper end linearly extending along the opening and closing direction; and the upper flange part 6232 having a plate shape extending from the upper end 6231*t* of the beam body 6231 in the opening and closing direction and to the rear side of the cage 70. The height raising member 5A includes: the bracket 56 that includes the angle part 560 having an L shape in cross section and including the first portion 561 extending along the upper flange part 6232 and the second portion 562 extending along the beam body 6231, and the at least one rib 565 connecting the first portion 561 and the second portion 562 to each other to maintain the angle of the second portion 562 to the first portion 561; the connecting members (first connecting members) 57 for connecting the first member 561 and the base part 511 of the height raising member 5A to each other with the upper flange part 6232 sandwiched between the first member 561 and the base part 511; and the connecting members (second connecting members) 57 for connecting the second member 562 and the beam body 6231 to each other. The bracket 56 is disposed at the corner formed by the upper end (upper flange part 6232) and the beam body 6231 as described above, and thus further increases the strength of the first beam 623.

Next, a description will be given on a third embodiment of the present invention with reference to FIG. 11 to FIG. 14. In this embodiment, the members and parts that are the same as those in the second embodiment above are denoted by the same reference numbers and will not be described in detail. A detail description will be given only on different members and parts from those in the second embodiment.

In the height raising member 5A of the second embodiment, the supporting part 521 of the second member 52 supports the motor 4 via the motor connecting member 54, but in a height raising member 5B of this embodiment, a supporting part 522B of a second member 52B directly supports a motor 4. A specific description will be given below.

As shown in FIG. 11 to FIG. 14, a car 7A according to this embodiment includes: a cage 70; a car door device 1; a base member 60 disposed on a ceiling wall 75 of the cage 70 and positionally fixed relative to the cage 70; and the height raising member 5B mounted to the base member 60.

A height raising member body 50B of this height raising member 5B is disposed on the ceiling wall of the cage 70. Specifically, the height raising member body 50B is mounted on an upper end of the base member 60 extending in an opening and closing direction above a frame 21 of the cage 70. The base member 60 of this embodiment includes two base members 60 disposed with a distance therebetween in an entrance direction on the ceiling wall 75 of the cage 70. A first base member 60A on a front side out of the two base members 60 extends in the opening and closing direction by the length substantially equal to a width of the height raising member 5B, and a second base member 60B on a rear side extends in the opening and closing direction and connects a pair of support channels 622 of a car frame 6 to each other.

The height raising member body 50B of this embodiment is fixed to the upper ends respectively of the base members 60A and 60B via a mounting plate 60C placed to bridge between the first base member 60A and the second base member 60B. The first base member 60A is a so-called channel steel, the second base member 60B is a so-called Z-steel (see FIG. 13), and the mounting plate 60C is a flat plate extending in the opening and closing direction and the entrance direction. The mounting plate 60C has holes 601C at positions corresponding to holes 511*a* of a first member 51B (i.e., at positions overlapping these holes as viewed from the vertical direction).

The height raising member body 50B includes: the first member 51B including a base part 511B connectable to the base members 60A and 60B (mounting plate 60C in the example of this embodiment), and an upwardly extending part 512B extending upward from the base part 511B; a second member 52B including a supporting part 522B extending in the vertical direction and capable of supporting the motor 4 at a position upward away from the base part 511; and at least one fixing member 53 fixing the second member 52B to the first member 51B. Further, the height raising member body 50B includes: a plurality of connecting members 57 for connecting the members to each other; and at least one push up member B capable of pushing the second member 52B upward relative to the first member 51B.

The first member 51B includes: the base part 511B connectable to the base members 60A and 60B (mounting plate 60C in the example of this embodiment); and the upwardly extending part 512B extending upward from the base part 511B.

The base part 511B is a plate-shaped portion extending in the opening and closing direction and the entrance direction, and has the plurality of holes 511*a* penetrating therethrough in the vertical direction. Each of the plurality of holes 511*a* is a long hole extending in the entrance direction. In the base part 511B of this embodiment, two groups each of which includes two holes 511*a* disposed with a distance therebetween in the entrance direction are disposed with a distance therebetween in the opening and closing direction. The base part 511B has a rectangular plate shape.

The upwardly extending part 512B is a plate-shaped (flat plate-shaped) portion extending upward from a front side end in the entrance direction of the base part 511B. Specifically, the upwardly extending part 512B has a plate shape extending in the opening and closing direction and the vertical direction, and has at least one first long hole 512*a*. The upwardly extending part 512B of this embodiment has two first long holes 512*a*, and the two first long holes 512*a* are disposed with a distance therebetween in the opening and closing direction. The upwardly extending part 512B has a recessed opening 5120 recessed downward from an upper end 512*t* of the upwardly extending part 512B between the two long holes 512*a*.

The recessed opening 5120 is defined by a pair of side edges 5120*s* respectively extending downward from the upper end 512*t* of the upwardly extending part 512B, and a bottom edge 5120*b* extending in the opening and closing direction and connecting the lower ends respectively of the pair of side edges 5120*s*. The recessed opening 5120 is recessed to a position lower than the lower ends of the first long holes 512*a*. That is, the bottom edge 5120*b* is positioned below the lower ends of the first long holes 512*a*. The dimension in the opening and closing direction of the bottom edge 5120*b* is larger than the dimension in the vertical direction of each side edge 5120*s*. In the opening and closing direction, a distance between one of the two first long holes 512*a* and the recessed opening 5120 (specifically, one of the pair of side edges 5120*s*) is equal to the distance between the other first long hole 512*a* and the recessed opening 5120 (specifically, the other side edge 5120*s*).

The second member 52B includes: the supporting part 522B having a plate shape extending in the vertical direction and the opening and closing direction; and an extending part 523 extending from the lower end of the supporting part 522B to the rear side in the entrance direction. The second member 52B of this embodiment further includes at least one reinforcing part 524 connecting the supporting part 522B and the extending part 523 to each other.

The supporting part 522B overlaps the upwardly extending part 512B of the first member 51B in parallel with each other, and has at least one second long hole 522*a*. The at least one second long hole 522*a* extends in the vertical direction at a position at which it at least partially overlaps the first long hole 512*a* of the upwardly extending part 512B. The supporting part 522B of this embodiment has the second long hole 522*a* at each of positions corresponding to the plurality of first long holes 512*a*. That is, the supporting part 522B has two second long holes 522*a* with a distance therebetween in the opening and closing direction.

The supporting part 523B has a hole 5221*a* penetrating therethrough in the entrance direction between the two second long holes 522*a* aligned in the opening and closing direction. The output shaft 42 of the motor 4 is inserted through the hole 5221*a*. The supporting part 522B of this embodiment has a rectangular plate shape elongated in the opening and closing direction, and has the hole 5221*a* at a central position between the two second long holes 522*a* aligned in the opening and closing direction. The hole 5221*a* is disposed at a position (height position) substantially the same in the vertical direction as the upper ends of the respective second long holes 422*a*. The supporting part 522B further has a plurality of holes 5221*b* around the hole 5221*a*. The plurality of holes 5221*b* are disposed to surround the hole 5221*b*. The central hole 5221*a* has a larger diameter than the diameter of each of the plurality of holes 5221*b* disposed around the hole 5221*a*.

The extending part 523 is a portion having a rectangular plate shape extending in the opening and closing direction and the entrance direction, with a rear side end portion in the entrance direction of the extending part 523 being bent downward. The extending part 523 has a plurality of holes 523*a* penetrating therethrough in the vertical direction. The plurality of holes 523*a* are disposed at intervals from each other in the opening and closing direction. The extending part 523 of this embodiment has two holes 523*a*. Each of the two holes 523*a* is a screw hole (tapped hole) having internal threads formed on its inner circumferential surface.

The at least one reinforcing part 524 connects an upper portion of the supporting part 522B and a rear portion of the extending part 523 to each other at an end in the opening and closing direction of the second member 52B. The reinforcing part 524 of this embodiment includes two reinforcing parts 524, and each of the two reinforcing parts 524 has a strip plate shape extending in a direction inclined to both the supporting part 522B and the extending part 523.

Figure 14:
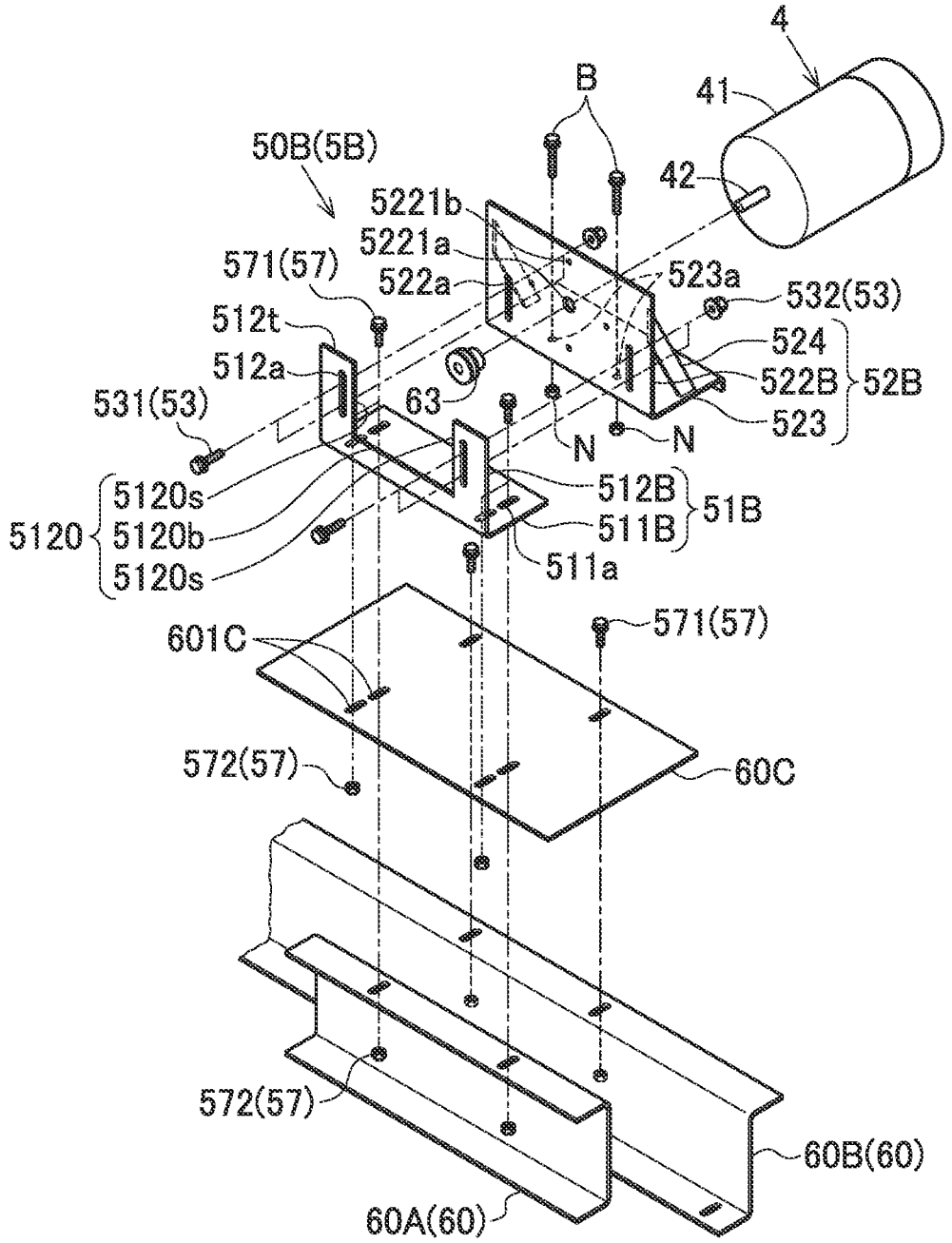
FIG. 14 is an exploded perspective view of a height raising member for raising a mounting position of a motor for an elevator door of the car, and members and parts therearound.

In the second member 52B, the fore part of the motor 4 (i.e., the part of the motor 4 through which the output shaft 42 projects) is connected to the supporting part 522B by the connecting members 57 (specifically the bolts 571: see FIG. 13) inserted through the respective holes 5221*b* of the supporting part 522B in the state where the output shaft 42 projects to the front side in the entrance direction through the hole 5221*a* of the supporting part 522B. That is, an end of the motor 4 on the side of the output shaft 42 is connected to the second member 52B (specifically, the supporting part 522B). In FIG. 14, the illustration of the connecting members 57 (bolts 571) for connecting the motor 4 to the supporting part 522B is omitted for the sake of facilitating the viewing of the figure.

The at least one fixing member 53 can be inserted through one of the first long holes 512*a* and the second long hole 522*a* corresponding to (overlapping) the first long hole 512*a* to thereby bring the supporting part 522B into engagement with the upwardly extending part 512B in a relatively movable manner in the vertical direction, and to enable the supporting part 522B to be fixed to the upwardly extending part 512B at a given relative position within a range based on the first long hole 512*a* and the second long hole 522*a* overlapping each other. In the height raising member body 50B of this embodiment, a plurality of (two in the example shown in FIG. 14) fixing members 53 are inserted through one of the first long holes 512*a* and the corresponding one of the second long holes 522*a* that are at least partially overlapping each other.

In the height raising member body 50B of this embodiment also, a distance adjusting part 59 is formed by the first long holes 512*a* and the second long holes 522*a* overlapping each other, and the fixing members 53 inserted through the first long holes 512*a* and the second long holes 522*a*. In the height raising member body 50B of this embodiment, two fixing members 53 (specifically, two bolts 531) are inserted through the first long hole 512*a* and the second long hole 522*a* overlapping each other. A plurality of groups each of which includes these two fixing members 53, and the first long hole 512*a* and the second long hole 522*a* through which the two fixing members 53 are inserted are disposed at intervals from each other in the horizontal direction. More specifically, two groups are disposed with a distance therebetween in the opening and closing direction.

The at least one push up member B is a jack-up bolt inserted downward through the hole 523*a* of the extending part 523 of the second member 52B. After the fixing members 53 are loosened to unfix the second member 52B from the first member 51B, the at least one push up member B having the shaft with external threads formed on its circumferential surface is caused to rotate about the shaft while the leading end of the shaft is held in contact with the base part 511B of the first member 51B, so that the position in the vertical direction of the second member 52B relative to the first member 51B (i.e., the distance in the vertical direction between the extending part 523 and the base part 511B) can be adjusted. As in the cases of the height raising members 5 and 5A of the first and second embodiments, a fastening member (nut in the example of this embodiment) N screwed with the at least one push up member B is fastened to fix the push up member B.

The height raising member 5B configured as above is connected to the base members 60A and 60B via the mounting plate 60C by fastening nuts 572 screwed with the respective bolts 571 inserted downward through the respective holes 511*a* of the first member 51B.

Even in the case where the motor 4 cannot be mounted to the frame 21 disposed close to the upper end of the entrance 71 of the cage 70 due to a large distance between the ceiling wall 75 of the cage 70 and the upper end of the entrance 71, the height raising member 5B of this embodiment and the car 7A equipped with the height raising member 5B enable the motor 4 to be disposed above the base members 60A and 60B positioned above the frame 21. This configuration enables the frame 21 to be disposed at a low position in the cage 70 even when the motor 4 is disposed above the ceiling wall 75 of the cage 70. Consequently, the height dimension of the car doors 3 can be suppressed.

In the height raising member 5B of this embodiment, the height raising member body 50B includes: the first member 51B including the base part 511B connectable to the base members 60A and 60B and the upwardly extending part 512B extending upward from the base part 511B; the second member 52B including the supporting part 522B extending in the vertical direction and capable of supporting the motor 4 at a position upward away from the base part 511B, the supporting part 522B being fixed to the first member 51B while overlapping the upwardly extending part 512B as viewed from the horizontal direction; and the distance adjusting part 59 capable of adjusting the distance between a pulley 23*a* and the motor 4. The distance adjusting part 59 includes: the first long hole 512*a* penetrating through the upwardly extending part 512B and extending in the vertical direction; the second long hole 522*a* penetrating through the supporting part 522B and extending in the vertical direction at a position at which the second long hole 522*a* at least partially overlaps the first long hole 512*a*; and the fixing member 53 inserted through the first long hole 512*a* and the second long hole 522*a* to bring the supporting part 522B into engagement with the upwardly extending part 512B in a relatively movable manner in the vertical direction, and to enable the supporting part 522B to be fixed to the upwardly extending part 512B at a given relative position within a range based on the first long hole 512*a* and the second long hole 522*a*. In the height raising member 5B of this embodiment also, the height raising member body 50B including the distance adjusting part 59 enables the distance between the pulley 23*a* and the motor 4 to be adjusted even in the state where the height raising member 5B mounted to the base members 60A and 60B supports the motor 4. This configuration can retighten a loosened second endless belt 45 that transmits the rotative power of the motor 4 to the pulley 23*a*, or finely adjust the height position of the motor 4 relative to the base members 60A and 60B. Moreover, this configuration enables relative movement between the first member 51B and the second member 52B in a mutually engaged state (that is, enables adjustment of the distance between the pulley 23*a* and the motor 4); thus, the motor 4 or the second member 52B can be prevented from, for example, falling when the distance between the pulley 23*a* and the motor 4 is adjusted.

In the height raising member 5B of this embodiment, two groups each of which is formed by the first long hole 512*a*, the second long hole 522*a*, and the fixing member 53 are disposed with a distance therebetween in the opening and closing direction. The upwardly extending part 512B has the recessed opening 5120 recessed downward from the upper end 512*t* of the upwardly extending part 512B between the two first long holes 512*a*, the supporting part 522B has the hole 5221*a* between the two long holes 522*b*, and the end of the motor 4 on the side of the output shaft 42 is connected to the supporting part 522B in the state where the output shaft 42 projects through the hole 5221*a*. As described above, the height raising member 5B can support the motor 4 so as to locate the output shaft 42 at a lower position than the upper end 512*t* of the upwardly extending part 512B.

It is a matter of course that a height raising member for raising a mounting position of a motor for an elevator door, a car door device equipped with the height raising member for raising the mounting position of the motor for the elevator door, and an elevator car equipped with the height raising member for raising the mounting position of the motor for the elevator door are not limited to the aforementioned embodiments, but various modifications can be made without departing from the gist of the present invention. For example, a configuration of an embodiment may be added to a configuration of another embodiment, and part of a configuration of an embodiment may be replaced by a configuration of another embodiment. Further, part of a configuration of an embodiment may be deleted.

The above first to third embodiments have been described by taking, for example, the case where the car door device 1 is a center-open type car door device having two car doors 3, without limitation thereto. The car door device 1 can be a so-called single-open type car door device. The number of car doors 3 (door panels 31) of the car door device 1 is not limited, either.

Figure 15:
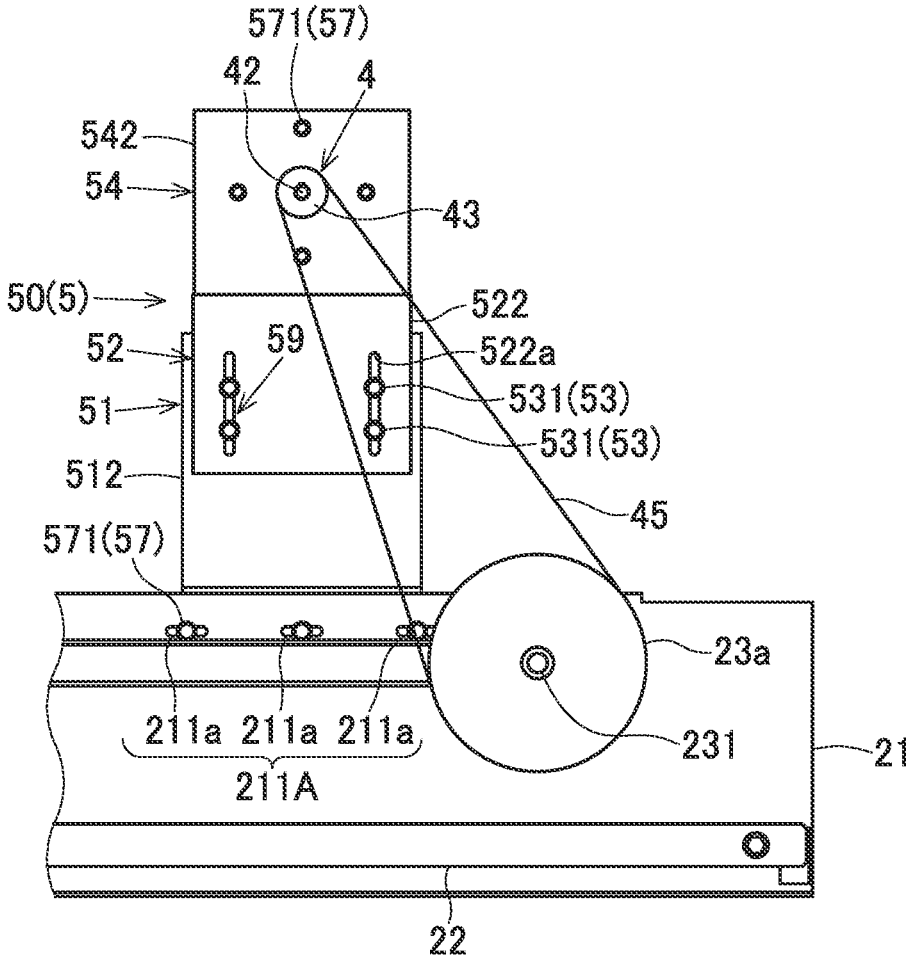
FIG. 15 is a front view of a height raising member for raising a mounting position of a motor for an elevator door according to another embodiment, and members and parts therearound.

The above first embodiment has been described by taking, for example, the case where the height raising member 5 includes the extension member 55, without limitation thereto. The height raising member 5 can be configured to have no extension member 55, that is, configured to have the height raising member body 50 directly mounted to the frame 21 (see FIG. 15). In this case, the base part 511 of the height raising member body 50 (first member 51) is connected to the bracket 56 (first portion 561) by fastening the connecting members 57 (bolts 571 and nuts 572) inserted through the respective holes 511*a* of the base part 511, the respective holes 212*a* of the flange part 212, and the respective holes 561*a* of the first portion 561 overlapping each other in the state where the flange part 212 of the frame 21 is sandwiched between the base part 511 and the first portion 561 of the bracket 56. Thereby, the height raising member body 50 (height raising member 5) is connected (fixed) to the upper end of the frame 21.

According to such a configuration too, the supporting part 521 of the height raising member 5 supports the motor 4 with the base part 511 of the height raising member 5 mounted to the upper end of the frame 21, so that the motor 4 is disposed at a position upward away from the frame 21 over a distance corresponding to the distance between the base 511 and the supporting part 521. This configuration enables the frame 21 to be disposed at a low position in the car 7 even when the motor 4 is disposed above the top board of the car 7, consequently suppressing the height dimension of the car doors 3.

In the height raising member 5 of the above first embodiment, the first member 51 and the extension member 55 share the same dimension in the vertical direction, but can have different dimensions.

The above first embodiment has been described by taking, for example, the case where the height raising member 5 has two extension members 55, without limitation thereto. The height raising member 5 can have one extension member 55, or three or more extension members 55.

The height raising members 5, 5A, and 5B of the above first to third embodiments each have the distance adjusting part 59, which can be omitted. In this case, for example, the height raising member body 50 can include the base part 511, the supporting part 521, 522B, and a connecting part extending in the vertical direction and connecting the base part 511 and the supporting part 521, 522B.

No specific configuration of the distance adjusting part 59 is limited. That is, the configuration can be such that the downwardly extending part 522 or the supporting part 522B of the second member 52, 52B while being engaged with the upwardly extending part 512, 12B of the first member 51, 51B is capable of relative movement in the vertical direction, and that the downwardly extending part 522 or the supporting part 522B is capable of being fixed to the upwardly extending part 512, 512B.

The above first to third embodiments have been described by taking, for example, the case where the height raising members 5, 5A, 5B each have the two fixing members 53 (bolts 531) inserted through the first long hole 512*a* and the second long hole 512*b* that form the distance adjusting part 59. However, the aforementioned embodiments are not limited to this configuration. The configuration can be such that one fixing member 53 or three or more fixing members 53 are inserted through the first long hole 512*a* and the second long hole 522*a* overlapping each other as viewed from the entrance direction. The height raising member 5, 5A, 5B of each of the above first to third embodiments has two groups each of which is formed by the first long hole 512*a*, the second long hole 522*a*, and the fixing members 53 inserted through the first long hole 512*a* and the second long hole 522*a*, but can have one group or three or more groups.

The above first embodiment has been described by taking, for example, the case where, in the height raising member 5, the direction in which the upwardly extending part 512 of the first member 51 and the downwardly extending part 522 of the second member 52 extend is orthogonal to the direction in which the extending part 552 of the extension member 55 extends as viewed from the vertical direction. However, the aforementioned embodiment is not limited to this configuration. In terms of strength, any extending directions can be employed as long as the direction in which the upwardly extending part 512 and the downwardly extending part 522 extend crosses the direction in which the extending part 552 extends as viewed from the vertical direction. In the case where, for example, both the height raising member body 50 and the extension member 55 secure sufficient strength, the configuration can be such that the direction in which the upwardly extending part 512 and the downwardly extending part 522 extend is in parallel with the direction in which the extending part 552 extends as viewed from the vertical direction.

In the car door device 1 of each of the above first to third embodiments, members are connected to each other by the bolts 571, or by the bolts 571 and the nuts 572, but can be connected to each other by other connecting members such as rivets.

Figure 16:
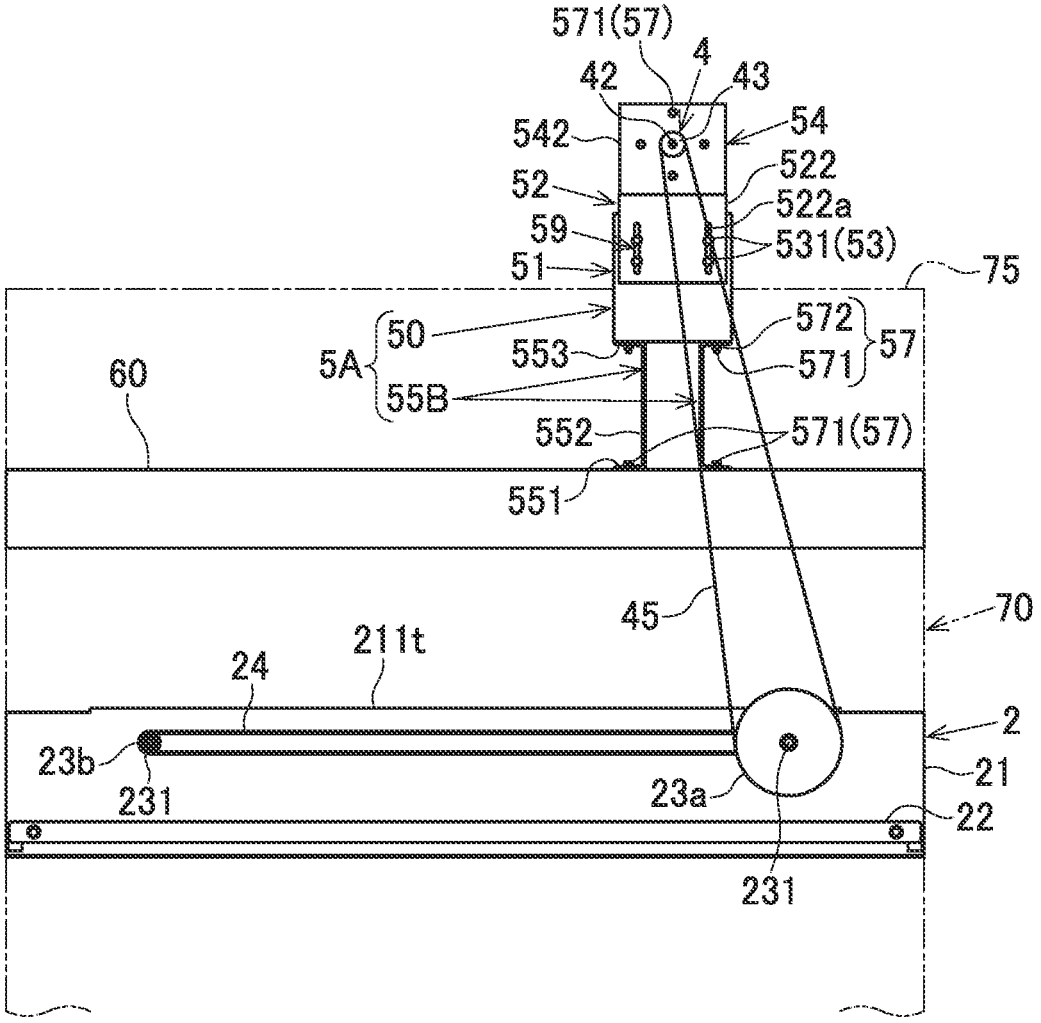
FIG. 16 is a front view of an upper part of a car equipped with a height raising member for raising a mounting position of a motor for an elevator door according to another embodiment, with some configurations thereof omitted.

The above second and third embodiments have been described by taking, for example, the case where the height raising member 5A, 5B is mounted to the first beam 623 of the car frame 6 or the base members 60A and 60B, which are disposed above the ceiling wall 75 of the cage 70. However, the aforementioned embodiments are not limited to this configuration. For example, as shown in FIG. 16, the configuration can be such that the height raising member 5A, 5B is mounted to a base member 60 extending in the opening and closing direction at a position in the vertical direction between the frame 21 and the ceiling wall 75 of the cage 70. That is, the configuration can be such that the height raising member 5A, 5B is mounted to the base member 60 extending in the opening and closing direction above the frame 21 and having such a strength as to be capable of supporting the height raising member 5A, 5B. The base member 60 can be positionally fixed relative to the car door device 1 (specifically, the frame 21), and thus can be fixed to the cage 70, can be mounted to the car frame 6, or can form a part of the car frame 6.

According to such a configuration also, the supporting part 521, 522B of the height raising member 5A, 5B supports the motor 4 with the base part 511, 511B of the height raising member 5A, 5B mounted to the upper end of the base member 60, so that the motor 4 is disposed at a position upward away from the base member 60 over a distance corresponding to the distance between the relative positions of the base part 511, 511B and the supporting part 521, 522B. This configuration enables the frame 21 to be disposed at a low position in the cage 70 even when the motor 4 is disposed above the ceiling wall 75 of the cage 70. Consequently, the height dimension of the car doors 3 can be suppressed.

The above second and third embodiments have been described by taking, for example, the case where, in the height raising member 5A, 5B, the height raising member body 50, 50B is mounted (connected) to the first beam 623 of the car frame 6 or the base members 60A and 60B disposed on the ceiling wall 75 of the cage 70. However, the aforementioned embodiments are not limited to this configuration. The configuration can be such that the height raising member body 50, 50B is mounted to the first beam 623 or the base members 60A and 60B via at least one extension member 55B extending in the vertical direction (see FIG. 16). That is, the configuration can be such that the height raising member 5A, 5B includes the at least one extension member 55B capable of being disposed between the base member 60 and the height raising member body 50, 50B.

Figure 17:
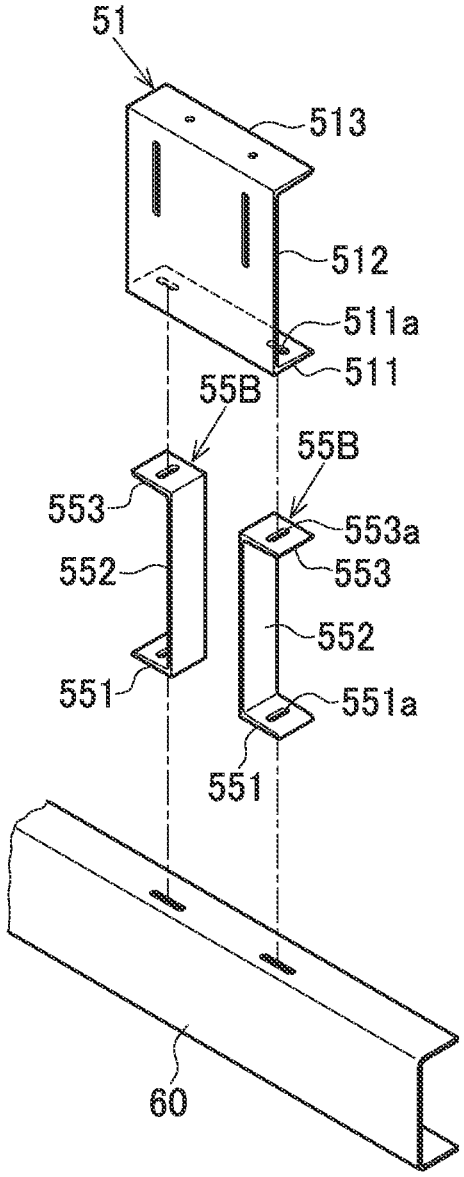
FIG. 17 is an exploded perspective view for illustrating a configuration of an extension member of the height raising member for raising the mounting position of the motor for the elevator door.

The extension member 55B has the same configuration as the extension member 55 of the first embodiment. Specifically, as shown in FIG. 16 and FIG. 17, the extension member 55B includes: a first connecting part 551 connectable to the base member 60; an extending part 552 extending upward from the first connecting part 551; a second connecting part 553 disposed at a leading end of the extending part 552 and connectable to the base part 511 of the height raising member body 50. The height raising member 5A, 5B includes a plurality of (two in the example shown in FIG. 16 and FIG. 17) extension members 55B, which are disposed at intervals from each other in the opening and closing direction. In the example shown in FIG. 16 and FIG. 17, the dimension in the vertical direction of each of the extension members 55B is equal to the dimension in the vertical direction of the first member 51.

The first connecting part 551 is a plate-shaped portion extending in the opening and closing direction and the entrance direction. In the example shown in FIG. 16 and FIG. 17, the first connecting part 551 has a rectangular plate shape, and has at least one hole 551*a* penetrating therethrough in the vertical direction. The at least one hole 551*a* is a long hole extending in the entrance direction.

The extending part 552 has a plate shape (flat plate shape) extending in a direction crossing the direction in which the upwardly extending part 512 and the downwardly extending part 522 extend as viewed from the vertical direction. Specifically, the extending part 552 has a plate shape extending in the entrance direction and the vertical direction. That is, the extending part 552 has a plate shape extending in a direction orthogonal to the direction in which the upwardly extending part 512 and the downwardly extending part 522 extend as viewed from the vertical direction. The extending part 552 extends upward from an end in the opening and closing direction of the first connecting part 551. In the example shown in FIG. 16 and FIG. 17, the extending part 552 has a rectangular shape elongated in the vertical direction, and extends upward from an inner end (on a side of the other extension member 55B) in the opening and closing direction of the first connecting member 551. The dimension in the entrance direction of the extending part 552 is equal to the dimension in the entrance direction of the first connecting part 551.

The second connecting part 553 is a plate-shaped portion extending in the opening and closing direction and the entrance direction. In the example shown in FIG. 16 and FIG. 17, the second connecting part 553 has a rectangular plate shape extending outward (to an opposite side to the other extension member 55B) from the upper end of the extending part 552, and has at least one hole 553*a* penetrating therethrough in the vertical direction. The at least one hole 553*a* is a long hole extending in the entrance direction. The dimension in the entrance direction of the second connecting part 553 is equal to the dimension in the entrance direction of the extending part 552. The second connecting part 553 is connected (fixed) to the base part 511 by the connecting member 57 (bolt 571 and nut 572) inserted through the hole 553*a* and the corresponding one of the holes 511*a* of the base part 511.

The example shown in FIG. 16 and FIG. 17 has been described by taking, for example, the case where the direction in which the upwardly extending part 512 of the first member 51 and the downwardly extending part 522 of the second member 52 extend is orthogonal to the direction in which the extending part 552 of the extension member 55B extends, as viewed from the vertical direction. However, the aforementioned example is not limited to this configuration. In terms of strength, any extending direction can be employed as long as the direction in which the upwardly extending part 512 (or 512B) and the downwardly extending part 522 (or the supporting part 522B) extend crosses the direction in which the extending part 552 of the extension member 55B extends as viewed from the vertical direction. In the case where, for example, both the height raising member body 50 (or 50B) and the extension member 55B secure sufficient strength, the configuration can be such that the direction in which the upwardly extending part 512 (or 512B) and the downwardly extending part 522 (or the supporting part 522B) extend is in parallel with the direction in which the extending part 552 extends as viewed from the vertical direction.

In the height raising member 5B configured such that the motor 4 is directly mounted to the supporting part 522B, as in the above third embodiment, no specific form of the recessed opening 5120 of the upwardly extending part 512B in the first member 51B is limited. The recessed opening 5120 of the first member 51B of the third embodiment is recessed downward from the upper end 512*t* of the upwardly extending part 512B in a rectangular form, but can be recessed in another form, such as an arc form. Further, the configuration can be such that the upwardly extending part 512B is split into two portions, that is, formed by two portions extending upward respectively from positions away from each other in the opening and closing direction at a front side end in the entrance direction of the base part 511B, to thereby define the recessed opening 5120 between one portion and the other portion of the upwardly extending part 512B.

Figure 18:
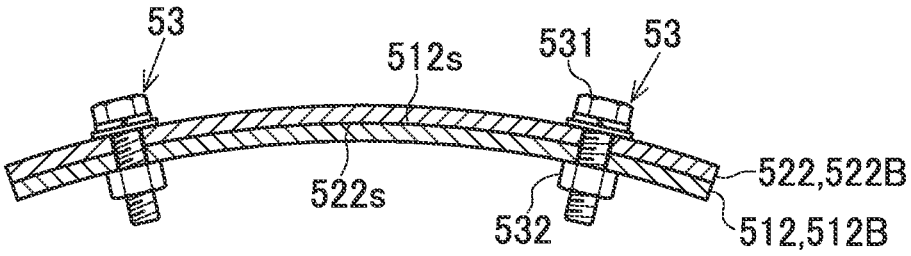
FIG. 18 is a cross-sectional view of a portion of a height raising member for raising a mounting position of a motor for an elevator door according to another embodiment, the portion having a first member and a second member overlapping each other.
Figure 19:
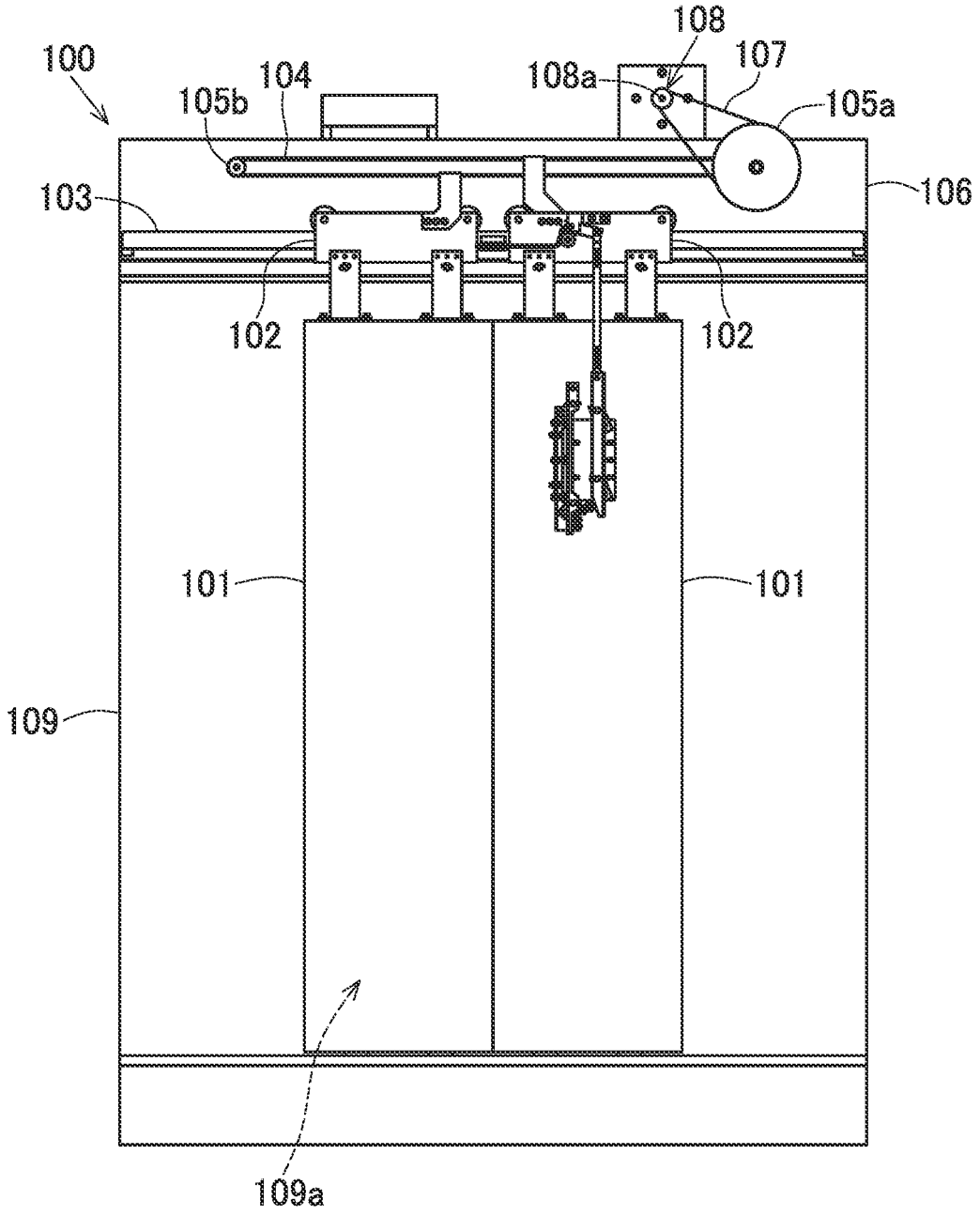
FIG. 19 is a front view of a car to which a conventional car door device is mounted.

The above first to third embodiments have been described by taking, for example, the case where, in the height raising member 5, 5A, 5B, the upwardly extending part 512, 512B of the first member 51, 51B and the downwardly extending part 522 or the supporting part 522B of the second member 52, 52B both have a flat plate shape extending along a plane extending in the vertical direction and the opening and closing direction. However, the aforementioned embodiments are not limited to this configuration. For example, as shown in FIG. 18, the configuration can be such that the upwardly extending part 512, 512B, and the downwardly extending part 522 or the supporting part 522B are both, for example, curved. That is, the configuration can be such that the upwardly extending part 512, 512B, and the downwardly extending part 522 or the supporting part 522B respectively have opposed surfaces 512*s*, 522*s* relatively movable (slidable) with each other in the vertical direction while being in contact with each other.

The above second embodiment has been described by taking, for example, the case where, in the height raising member 5A, the height raising member body 50 is mounted to the base member 60 in the state where the based member 60 is sandwiched between the height raising member body 50 and the bracket 56. However, the aforementioned embodiment is not limited to this configuration. In the case where the base member 60 have sufficient strength, the configuration can be such that the height raising member body 50 is mounted to the base member 60 by the connecting members 57 such as bolts without use of the bracket 56, as in the case of the height raising member 5B of the above third embodiment. The above third embodiment has been described by taking, for example, the case where, in the height raising member 5B, the height raising member body 50B is mounted to the base member 60 by the connecting members 57 (bolts 571 and nuts 572). However, the aforementioned embodiment is not limited to this configuration. The configuration can be such that the height raising member body 50B is mounted to the base member 60 in the state where the base member 60 is sandwiched between the height raising member body 50B and the bracket 56, as in the case of the height raising member 5A of the above second embodiment.

The height raising member for raising the mounting position of the motor for the elevator door, the car door device equipped with the height raising member for raising the mounting position of the motor for the elevator door, and the elevator car equipped with the height raising member for raising the mounting position of the motor for the elevator door, of the present embodiments are as described above, but the present invention is not limited to the aforementioned embodiments, and the design can be appropriately modified within the scope intended by the present invention. The operational advantages of the present invention are not limited to the foregoing embodiments, either. The embodiments disclosed herein should be construed in all respects as illustrative but not limiting. The scope of the present invention is not indicated by the foregoing description but by the scope of the claims. Further, the scope of the present invention is intended to include all the modifications equivalent in the sense and the scope of the claims

What is claimed is:

1. A height raising member for raising a mounting position of a motor for an elevator door, the height raising member comprising:

a height raising member body mountable to an upper end of a frame disposed above an entrance of a car that moves up and down through an elevator shaft, wherein a rail for guiding a car door in an opening and closing direction and a pulley for use in opening and closing drive of the car door are mounted to the frame, the height raising member body comprising: a base part connectable to the frame; and a supporting part capable of supporting the motor at a position upward away from the base part, the motor being configured to drive the pulley via a belt, the height raising member body further comprising:

a distance adjusting part capable of adjusting a distance between the pulley and the motor;

a first member comprising the base part and an upwardly extending part extending upward from the base part;

a second member comprising the supporting part and a downwardly extending part extending downward from the supporting part, the second member being fixed to the first member with the downwardly extending part overlapping the upwardly extending part as viewed from a horizontal direction; and at least one push up member capable of pushing the second member upward relative to the first member, the distance adjusting part comprising:

at least one first long hole formed in the upwardly extending part and extending in a vertical direction;

at least one second long hole formed in the downwardly extending part and extending in the vertical direction at a position at which the at least one second long hole at least partially overlaps the at least one first long hole; and at least one fixing member inserted through the at least one first long hole and the at least one second long hole to bring the downwardly extending part into engagement with the upwardly extending part in a relatively movable manner in the vertical direction, and to enable the downwardly extending part to be fixed to the upwardly extending part at a given relative position within a range based on the at least one first long hole and the at least one second long hole.

2. The height raising member for raising the mounting position of the motor for the elevator door according to claim 1, wherein a plurality of groups each of which comprises the at least one first long hole, the at least one second long hole, and the at least one fixing member are disposed at intervals from each other in the horizontal direction.

3. The height raising member for raising the mounting position of the motor for the elevator door according to claim 1, the height raising member comprising:

an extension member connectable to the base part of the height raising member body, wherein the upwardly extending part and the downwardly extending part have a flat plate shape overlapping each other in parallel with each other, the extension member comprises: a first connecting part connectable to the frame;

an extending part extending upward from the first connecting part; and a second connecting part disposed at a leading end of the extending part and connectable to the base part, and the extending part has a flat plate shape extending in a direction that crosses the upwardly extending part and the downwardly extending part as viewed from the vertical direction.

4. A car door device comprising:

a car door for opening and closing an entrance of a car that moves up and down through an elevator shaft;

a frame part comprising: a frame disposed above the entrance of the car; a rail disposed on the frame and guiding the car door in an opening and closing direction; and a pulley disposed to the frame and for use in opening and closing drive of the car door;

the height raising member for raising the mounting position of the motor for the elevator door according to claim 1; and the motor supported by the height raising member for raising the mounting position of the motor for the elevator door, the motor being configured to drive the pulley via a belt.

5. The car door device according to claim 4, wherein the frame comprises:

a frame body having a plate shape extending in a vertical direction and the opening and closing direction above the entrance of the car, and having an upper end linearly extending along the opening and closing direction; and a flange part having a plate shape and extending from the upper end of the frame body in the opening and closing direction and to a rear side of the car, and the height raising member for raising the mounting position of the motor for the elevator door comprises:

a bracket comprising: an angle part having an L shape in cross section and comprising a first portion extending along the flange part and a second portion extending along the frame body; and at least one rib connecting the first portion and the second connection to each other to maintain an angle of the second portion to the first portion;

at least one first connecting member that connects the first portion and the base part of the height raising member to each other with the flange part sandwiched between the first portion and the base part; and at least one second connecting member that connects the second portion and the frame body to each other.

6. A height raising member for raising a mounting position of a motor for an elevator door, the height raising member comprising:

a height raising member body mountable to an upper end of at least one base member extending in an opening and closing direction above a frame disposed above an entrance of a cage, the frame comprising: a rail for guiding a car door in the opening and closing direction; and a pulley for use in opening and closing drive of the car door, the height raising member body comprising: a base part connectable to the at least one base member; a supporting part capable of supporting the motor at a position upward away from the base part, the motor being configured to drive the pulley via a belt;

a first member comprising the base part connectable to the at least one base member and an upwardly extending part extending upward from the base part;

a second member comprising the supporting part capable of supporting the motor at the position upward away from the base part and a downwardly extending part extending downward from the supporting part, the second member being fixed to the first member with the downwardly extending part overlapping the upwardly extending part as viewed from a horizontal direction;

at least one push up member capable of pushing the second member upward relative to the first member; and a distance adjusting part capable of adjusting a distance between the pulley and the motor, the distance adjusting part comprising:

at least one first long hole formed in the upwardly extending part and extending in a vertical direction;

at least one second long hole formed in the downwardly extending part and extending in the vertical direction at a position at which the at least one second long hole at least partially overlaps the at least one first long hole; and at least one fixing member inserted through the at least one first long hole and the at least one second long hole to bring the downwardly extending part into engagement with the upwardly extending part in a relatively movable manner in the vertical direction, and to enable the downwardly extending part to be fixed to the upwardly extending part at a given relative position within a range based on the at least one first long hole and the at least one second long hole.

7. The height raising member for raising the mounting position of the motor for the elevator door according to claim 6, wherein a plurality of groups each of which comprises the at least one first long hole, the at least one second long hole, and the at least one fixing member are disposed at intervals from each other in the horizontal direction.

8. The height raising member for raising the mounting position of the motor for the elevator door according to claim 6, wherein a plurality of the fixing members are inserted to the at least one first long hole and the at least one second long hole that are at least partially overlapping each other.

9. The height raising member for raising the mounting position of the motor for the elevator door according to claim 6, wherein the height raising member body comprises:

a first member comprising the base part connectable to the at least one base member and an upwardly extending part extending upward from the base part;

a second member extending in a vertical direction and comprising the supporting part capable of supporting the motor at the position upward away from the base part, the second member being fixed to the first member with the supporting part overlapping the upwardly extending part as viewed from a horizontal direction; and a distance adjusting part capable of adjusting a distance between the pulley and the motor, and the distance adjusting part comprises:

at least one first long hole formed in the upwardly extending part and extending in the vertical direction;

at least one second long hole formed in the supporting part and extending in the vertical direction at a position at which the at least one second long hole at least partially overlaps the at least one first long hole; and at least one fixing member inserted through the at least one first long hole and the at least one second long hole to bring the supporting part into engagement with the upwardly extending part in a relatively movable manner in the vertical direction, and to enable the supporting part to be fixed to the upwardly extending part at a given relative position within a range based on the at least one first long hole and the at least one second long hole.

10. A height raising member for raising a mounting position of a motor for an elevator door, the height raising member comprising:

a height raising member body mountable to an upper end of at least one base member extending in an opening and closing direction above a frame disposed above an entrance of a cage, the frame comprising: a rail for guiding a car door in the opening and closing direction; and a pulley for use in opening and closing drive of the car door, the height raising member body comprising:

a base part connectable to the at least one base member; a supporting part capable of supporting the motor at a position upward away from the base part, the motor being configured to drive the pulley via a belt;

a supporting part connecting part connected to the supporting part; and a motor connecting part extending upward from the supporting part connecting part and to which an end of the motor on a side of an output shaft is connectable.

11. A height raising member for raising a mounting position of a motor for an elevator door, the height raising member comprising:

a height raising member body mountable to an upper end of at least one base member extending in an opening and closing direction above a frame disposed above an entrance of a cage, the frame comprising: a rail for guiding a car door in the opening and closing direction; and a pulley for use in opening and closing drive of the car door, the height raising member body comprising: a base part connectable to the at least one base member; a supporting part capable of supporting the motor at a position upward away from the base part, the motor being configured to drive the pulley via a belt, a first member comprising the base part connectable to the at least one base member and an upwardly extending part extending upward from the base part;

a second member extending in a vertical direction and comprising the supporting part capable of supporting the motor at the position upward away from the base part, the second member being fixed to the first member with the supporting part overlapping the upwardly extending part as viewed from a horizontal direction; and a distance adjusting part capable of adjusting a distance between the pulley and the motor, the distance adjusting part comprising:

at least one first long hole formed in the upwardly extending part and extending in the vertical direction;

at least one second long hole formed in the supporting part and extending in the vertical direction at a position at which the at least one second long hole at least partially overlaps the at least one first long hole; and at least one fixing member inserted through the at least one first long hole and the at least one second long hole to bring the supporting part into engagement with the upwardly extending part in a relatively movable manner in the vertical direction, and to enable the supporting part to be fixed to the upwardly extending part at a given relative position within a range based on the at least one first long hole and the at least one second long hole, wherein two groups each of which comprises the at least one first long hole, the at least one second long hole, and the at least one fixing member are disposed with a distance therebetween in the opening and closing direction, the upwardly extending part has a recessed opening recessed downward from an upper end of the upwardly extending part between the two first long holes, and the supporting part has a hole between the two second long holes, and is capable of fixing thereto an end of the motor on a side of an output shaft, with the output shaft of the motor projecting through the hole.

12. An elevator car comprising:

a car door;

a frame comprising a rail for guiding the car door in an opening and closing direction, and a pulley for use in opening and closing drive of the car door;

a cage having an entrance and having the frame disposed above the entrance;

at least one base member extending in the opening and closing direction above the frame;

a height raising member for raising a mounting position of a motor for an elevator door; and the motor supported by the height raising member for raising the mounting position of the motor for the elevator door, the motor being configured to drive the pulley via a belt, wherein the height raising member for raising the mounting position of the motor for the elevator door is mounted to an upper end of the at least one base member, the height raising member for raising the mounting position of the motor for the elevator door comprising a height raising member body mountable to the upper end of the at least one base member, the height raising member body comprising: a base part connectable to the at least one base member; and a supporting part capable of supporting the motor at a position upward away from the base part.

13. The elevator car according to claim 12, comprising a car frame supporting the cage, wherein the at least one base member is a member forming a part of the car frame, or is a member disposed on a ceiling wall of the cage.

14. The elevator car according to claim 12, wherein the at least one base member comprises:

a body having a plate shape extending in a vertical direction and the opening and closing direction above the frame, and having an upper end linearly extending along the opening and closing direction; and a flange part having a plate shape and extending from the upper end of the body in the opening and closing direction and to a rear side of the cage, and the height raising member for raising the mounting position of the motor for the elevator door comprises:

a bracket comprising: an angle part having an L shape in cross section and comprising a first portion extending along the flange part and a second portion extending along the body; and at least one rib connecting the first portion and the second portion to each other to maintain an angle of the second portion to the first portion;

at least one first connecting member that connects the first portion and the base part of the height raising member to each other with the flange part sandwiched between the first portion and the base part; and at least one second connecting member that connects the second portion and the base member to each other.

* * * * *